US008312850B1

(12) United States Patent
Braman

(10) Patent No.: US 8,312,850 B1
(45) Date of Patent: Nov. 20, 2012

(54) VALVE TRAIN CONTROL DEVICE

(76) Inventor: Barry Braman, Lancaster, CA (US)

( * ) Notice: Subject to any disclaimer, the term of this patent is extended or adjusted under 35 U.S.C. 154(b) by 233 days.

(21) Appl. No.: 12/843,570

(22) Filed: Jul. 26, 2010

(51) Int. Cl.
*F01L 1/34* (2006.01)

(52) U.S. Cl. ..... 123/90.16; 123/90.39

(58) Field of Classification Search ..... 123/90.16, 123/90.15, 90.48, 90.31, 90.39
See application file for complete search history.

(56) References Cited

U.S. PATENT DOCUMENTS

| | | | | |
|---|---|---|---|---|
| 4,643,141 | A | 2/1987 | Bledsoe | |
| 4,836,155 | A | 6/1989 | Slagley et al. | |
| 4,878,464 | A | 11/1989 | Richeson, Jr. et al. | |
| 4,901,684 | A | 2/1990 | Wride | |
| 5,056,476 | A | 10/1991 | King | |
| 5,085,181 | A | 2/1992 | Feuling | |
| 5,205,247 | A | 4/1993 | Hoffman | |
| 5,392,743 | A | 2/1995 | Dokonal | |
| 5,553,573 | A | 9/1996 | Hara et al. | |
| 6,135,074 | A * | 10/2000 | Kuhl | 123/90.16 |
| 6,189,497 | B1 | 2/2001 | Griffiths | |
| 6,257,190 | B1 | 7/2001 | Linebarger | |
| 6,340,010 | B1 | 1/2002 | Hara et al. | |
| 6,684,832 | B1 | 2/2004 | Codina et al. | |
| 7,363,893 | B2 | 4/2008 | Rohe et al. | |
| 7,383,801 | B1 | 6/2008 | Siepmann et al. | |
| 2003/0127063 | A1 | 7/2003 | Wang | |
| 2009/0241881 | A1 | 10/2009 | Nishida et al. | |

* cited by examiner

*Primary Examiner* — Zelalem Eshete
(74) *Attorney, Agent, or Firm* — Advantage IP Law Firm

(57) ABSTRACT

A valve train control device, for use in a reciprocating piston internal combustion engine having a camshaft with a primary cam lobe, is provided herein and generally includes a primary cam follower positioned in an operational path between the primary cam lobe and a corresponding valve with the primary cam follower being constructed to follow the primary cam lobe while an auxiliary motion transfer device, responsive to at least one engine parameter, may be coupled to the primary cam follower to shift the primary cam follower relative to the primary cam lobe during at least a portion of the camshaft rotation to alter one or more valve operating parameters relative to a set of valve parameters defined by the primary cam lobe profile interacting with an unshifted primary cam follower.

18 Claims, 16 Drawing Sheets

VALVE TRAIN CONTROL DEVICE

BACKGROUND OF THE INVENTION

1. Field of the Invention

The present invention relates to valve train control systems for reciprocating piston internal combustion engines and more specifically to valve train control systems for variably altering the duration and/or timing characteristics of the valves during crankshaft/camshaft rotation.

2. Background Art

FIG. 1 depicts a conventional cam lobe and valve interface, generally designated 30, for a single valve (intake or exhaust) in an overhead cam system. As readily understood by one of ordinary skill in the art, a camshaft 32 coupled to the crankshaft of a combustion engine is machined or cast to include one or more cam lobes 34 that include an peripheral working surface 36 defined by the cam lobe profile 38. The cam lobe profile includes a broad shallow region or base circle 40 for a zero lift position when the valve is seated and the combustion chamber closed, a more narrow opposing region or nose 42 for a maximum valve lift position opening a pathway to the combustion chamber, and a pair of opposing relatively large radius of curvature transition regions or flanks 44*a*, 44*b* in between.

With continued reference to the conventional configuration in FIG. 1, the cam lobe 34 interacts with a valve, generally designated 46, that includes a cam follower 48 and a spring retainer 56 cooperating to form a cam follower and spring retainer assembly, an elongated valve stem 50, and a valve head 52 for sealing off the combustion chamber. At the top end of the cam follower 48, a planar upper cam following surface 54 interacts with and follows the rotating peripheral working surface 36 of the cam lobe 34 as the cam lobe rotates with the camshaft 32 to open and close the valve 46 in operation allowing air to enter the combustion chamber if an intake valve or exhaust gases to exit if an exhaust valve. A biasing element such as a spring (not shown) is maintained at least partially within the spring retainer 56 and typically biases the valve head 52 toward a closed position against the valve seat (not shown in FIG. 1). The force of the cam lobe working surface 36 against the valve follower surface 54 must overcome this spring force to drive the valve into an open position. In operation, the rotational motion of the camshaft 32 and cam lobe 34 is translated into a reciprocal linear valve motion. It will be appreciated that the foregoing would be readily understood by one of ordinary skill in the art but has been merely provided as a matter of general background. It will also be appreciated that the camshaft may incorporate one or more cam lobes that interact with a corresponding set of intake and exhaust valves and that one or more intermediate components (not shown) such as pushrods, finger followers, and/or rocker arms may be interposed in the operational path between the cam lobe and the follower depending on the valve train configuration.

In the normal four-stroke (Otto Cycle) internal combustion engine as it now exists, each cam lobe on one or more camshafts controls the opening and closing of individual intake and exhaust valves. A camshaft is driven at half the crankshaft rotational speed. Operation of a four-stroke internal combustion engine consists of four separate one-half rotation cycles of the crankshaft, each one moving the piston from either top to bottom of its stroke or vice versa as follows: 1) the intake stroke is when a piston moves from top to bottom in its cylinder, sucking in the air/fuel mixture with the intake valve open; 2) the compression stroke is when the same piston moves from the bottom to top in its cylinder, compressing the air/fuel mixture with both intake and exhaust valves closed; 3) the power stroke is when the same piston moves from top to bottom in its cylinder after the spark plug ignites the air/fuel mixture; and 4) the exhaust stroke is when the same piston moves from bottom to top, pushing the burned air/fuel mixture out of the cylinder with the exhaust valve open.

If the cam lobe timing and duration is such that the intake and exhaust valves are only open during the extent of their respective stroke, the engine would be restricted to low crankshaft rotations per minute (RPM) operation and low total engine power output. This RPM operating range would offer extremely low idle speeds (conserving fuel) and high torque values at low-speed. Due to acceleration and deceleration limits of such a valve train, the area under a graphical plot of valve lift versus crankshaft rotation for "stroke extent" timing/duration would be very low, however.

At high RPM, the breathing efficiency would be too low for any significant level of power. To raise the breathing efficiency to a level required for useable total engine power necessitates taking advantage of the momentum of the air/fuel mixture as it starts and stops flowing past the valves near the closed position. Conventional testing and experience has taught that the higher the RPM desired for power, the longer the duration of each cam lobe needs to be. This extension of duration timing at the opening and closing of the valves is not uniform but it greatly increases the area under a plot of the lift/duration curve.

Since the end of the exhaust cycle corresponds with the beginning of the intake cycle (at the top of piston travel), any extension of the duration for cam lobes results in valve "overlap", where both valves are open at the same time, During this "overlap" period, the exhaust valve is finishing its closing phase while the intake valve is starting its opening phase.

Valve openings and closings near the bottom of piston travel have different parameters from those at the top of piston travel. Extending the closing of the intake valve timing into the beginning of the compression stroke takes into account the momentum of the intake charge near the bottom of piston travel. A considerable amount of intake valve opening is desirable at the bottom of the piston stroke. Extending the opening of the exhaust valve early into the end of the power stroke provides more time for the high-pressure exhaust gases to exit the cylinder. An additional factor allowing considerable timing extension of these two events is the crankshaft rotational position/connecting rod angle relationship. The piston does not exhibit a lot of motion in the cylinder near bottom of travel compared to top of travel. Valve duration timing of these two events is considerably more extended than the overlap timing.

If the cam lobe timing and duration allowed sufficient overlap of valve opening and closing, along with late intake valve closing and early exhaust valve opening, breathing efficiency at high RPM would be greatly increased. Although at very low RPM, efficiency would be impaired, fuel economy reduced, and pollution increased.

Fixed duration and timing of the valve cam lobes yields good results only in a fairly narrow range of RPM, and is a significant compromise in the other operational RPM bands. Current engine technology has added the capability to vary the cam lobe timing phase, in some cases intake and exhaust individually, but this amounts to little more than fine tuning compared to what is desirable. A typical lift profile curve for a conventional engine without any timing variations is shown in FIG. 14 while that of a valve train incorporating phase (timing) shifting technology is shown in FIG. 15. A currently unattained ideal system is shown in FIG. 16 and a lift profile curve for cam switching technology such as for Honda's VTEC engine system is shown in FIG. 18. Each of these are discussed below in more detail.

No mechanism exists in practice today that permits continuous variable control of the duration of valve opening during engine operation. Such valve duration variation is necessary for optimizing engine function with varying conditions to meet current and anticipated federal regulations for fuel consumption and exhaust pollution. The principal change in engine operating conditions, for which variable valve open duration is advantageous, is change in RPM. Other engine operating parameters such as throttle position, manifold vacuum, air temperature and pressure have a smaller effect on engine operating conditions and may be employed as signals for valve open duration adjustment. For diesel engines, compression ratio and cylinder pressure are significant factors that would add to the RPM and fuel feed rate (equivalent throttle position) determination for the valve duration and timing.

Given the drawbacks of conventional valve train technology, there exists a need for an engine system incorporating an improved variable valve train control device for altering the valve characteristics during crankshaft/camshaft rotation to serve a wider range of engine speeds using a single cam lobe profile set.

SUMMARY OF THE INVENTION

In accordance with the principles of the present invention, a valve train control device, for use in a reciprocating piston internal combustion engine having a camshaft with a primary cam lobe defining a primary cam lobe profile constructed to directly or indirectly translate camshaft rotational motion into linear motion of a corresponding valve in accordance with the profile, is provided with a primary cam follower positioned in an operational path between the primary cam lobe and the corresponding valve and constructed to follow the primary cam lobe while an auxiliary motion transfer device may be coupled to the primary cam follower and, in response to at least one engine parameter, slide the primary cam follower along the primary cam lobe from an unshifted position to one or more shifted positions during at least a portion of the camshaft rotation to alter at least one valve operating parameter relative to a set of valve parameters defined by the primary cam lobe profile interacting with an unshifted primary cam follower.

In another aspect of the present invention, a secondary cam lobe and secondary cam follower are provided and the auxiliary motion transfer device is in the form of a linkage including a lever and a transfer arm coupling the secondary cam follower to the primary cam follower.

In yet another aspect of the present invention, a controller in contact with a reaction surface and one edge of the lever may be selectively moved through a variety of positions to variably impact the valve parameters in response to one or more engine operating parameters.

Another feature of the present invention is the incorporation of a rocking or adjustable orientation primary cam follower.

Other aspects of the present invention include a primary cam follower with a variable orientation following surface having an opposing outwardly bowed portion constructed to slide along a saddle region at the end of the valve stem opposing the valve head allowing for reorientation of the following surface relative to the primary cam lobe.

Other aspects of the present invention will become apparent with further reference to the following drawings and specification.

DETAILED DESCRIPTION OF THE PREFERRED EMBODIMENTS

Figure 1:
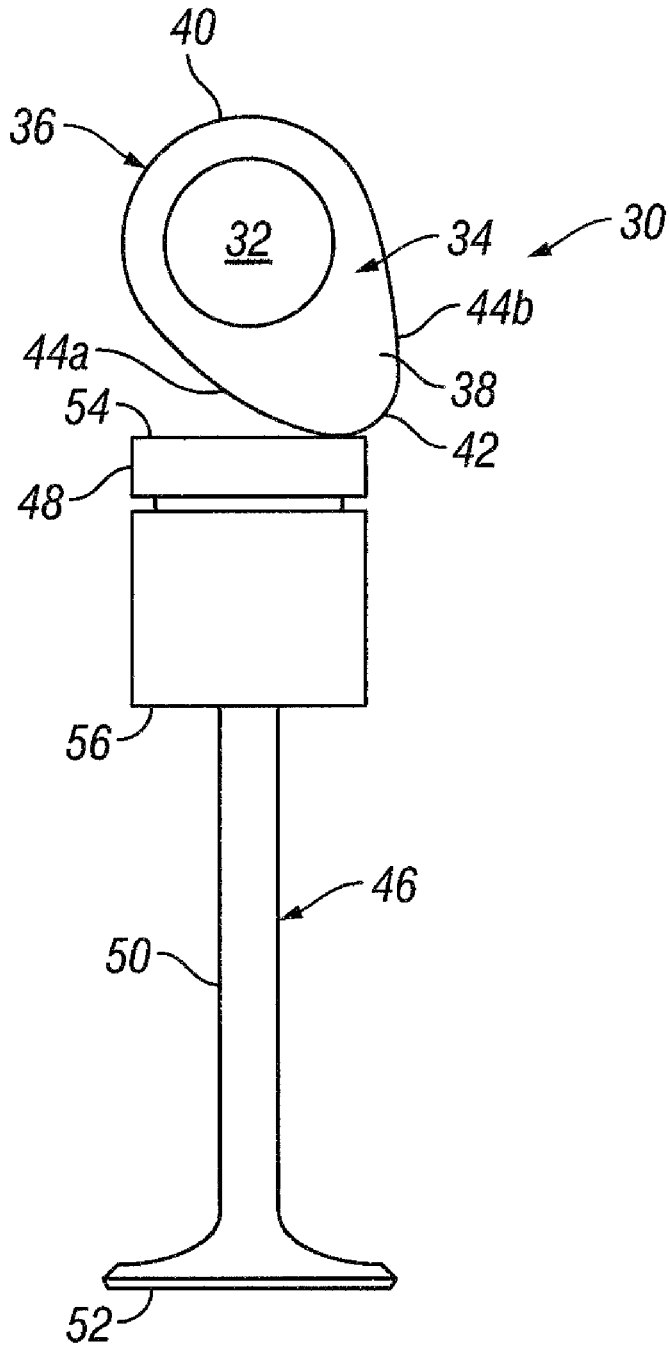
FIG. 1 (Prior Art)
FIG. 1 is an exemplary conventional overhead cam configuration depicting a cam profile for a valve with a bucket style follower for use in a reciprocating piston internal combustion engine.

In general terms, a first embodiment of a valve train control device, as shown in FIGS. 2-13 and generally designated 100 herein, may be comprised of a series of components that may include a camshaft provided with a primary cam lobe set having a long duration profile and a secondary cam lobe set mechanically linked to a variable position primary cam follower set for variably adjusting the duration that the associated intake or exhaust valves project into the corresponding combustion chambers. The motion of the components generally starts with the secondary cam lobe, eccentric in general appearance in this exemplary embodiment, and ends at the follower of the primary cam lobe for each valve of a reciprocating piston internal combustion engine. A control component varies the imparted motion of the mechanically linked components ending with variable reciprocating motion at the follower for the primary cam lobe. When engaged, the motion of the secondary cam lobe follower may have the effect of shortening the duration of opening at the valve. One exemplary full range of valve opening duration change may be in the 30 to 40 degree area but this is not meant to be limiting in any manner.

Referring now more specifically to FIGS. 2-13, a portion of a cylinder head 101 is cutaway to reveal a first embodiment of the valve train control device 100 constructed in accordance with the principles of the present invention. The device 100 may advantageously be used with a corresponding valve, generally designated 102, to variably alter the direct or indirect interaction between a modified bucket style primary cam follower 114 resting atop a follower saddle 104 of a cam follower and spring retainer assembly, disposed on an end of a valve stem 106 opposing a valve head 108, and a primary cam lobe (PCL) 110 projecting from a corresponding camshaft 112 to change the valve characteristics such as duration and timing. While it will be appreciated that more than one cam lobe and valve may be used in a system incorporating the valve train control device 100, the construction and interaction of the device 100 for a single valve is explained herein with the understanding that a similar construction may be used for any other primary cam lobe/valve sets.

Figure 2:
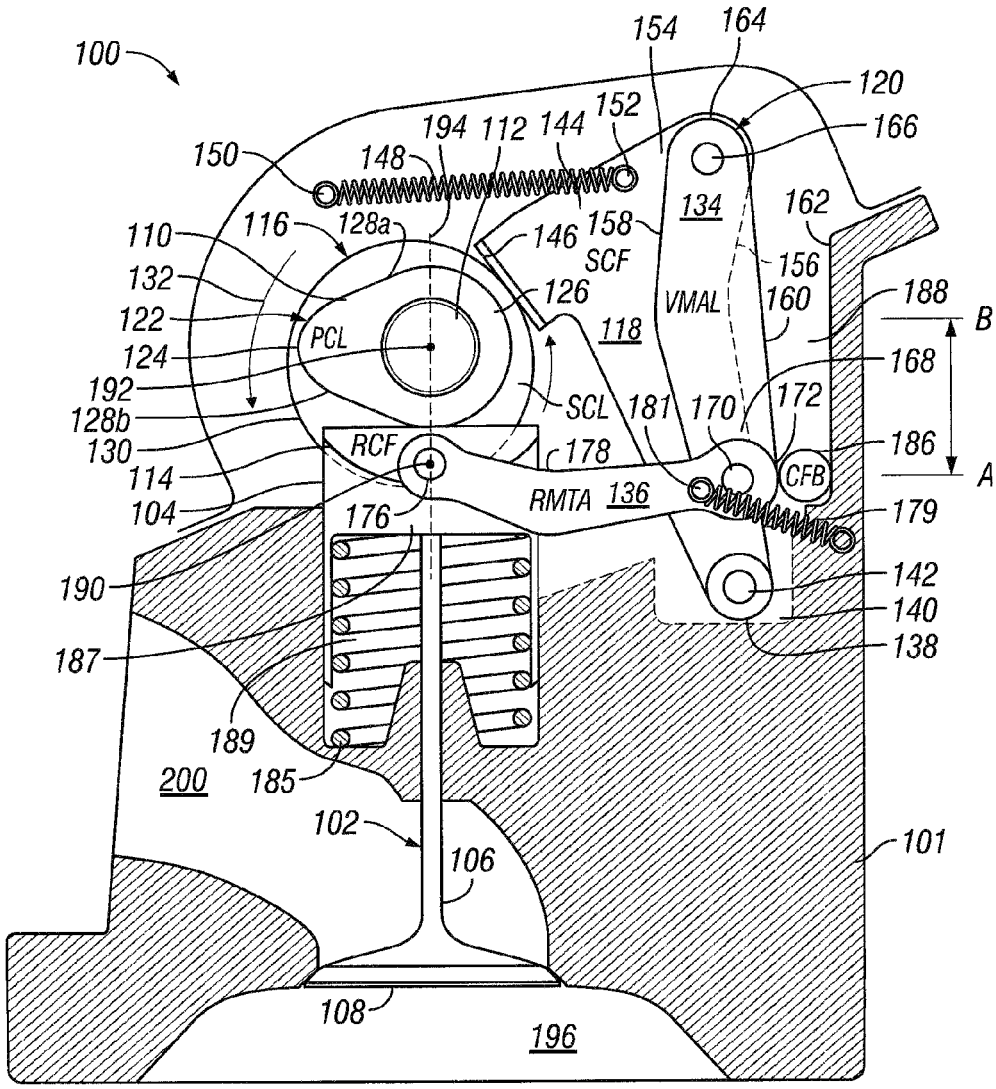
FIG. 2 is a cutaway view of a cylinder head in a conventional reciprocating piston internal combustion engine having a camshaft and a primary cam lobe defining a primary cam lobe profile with the corresponding valve in a closed position and further depicting a modified bucket style follower and corresponding valve train control device in a disengaged or neutral position in accordance with principles of the present invention.

With specific reference to FIG. 2, the variable position primary cam follower 114 of the valve train control device 100 generally includes a convex lower surface resting atop and slidably coupled to an uppermost complementary concave saddle 104. Opposing the convex lower surface, the primary cam follower includes a planar following surface constructed to follow the external working surface of the primary cam lobe 110 in operation in accordance with the primary cam lobe profile. The control device 100 further includes a secondary cam lobe 116 projecting from the camshaft 112 that may be followed by a secondary cam follower 118. Like the primary cam follower, the secondary cam follower includes a planar following surface for following the external working surface of the secondary cam lobe. To alter the orientation of the primary cam follower relative to the primary cam lobe that will result in the alteration of at least one valve operating parameter including duration and/or timing characteristics in response to the rotation of the camshaft, an auxiliary motion transfer device, generally designated 120, may be provided to couple the primary cam follower 114 to the secondary cam follower 118. The auxiliary motion transfer device is preferably selectively operable or programmed to respond to a command by man or machine to move between a disengaged (or neutral, no impact) position and one or more engaged positions to accomplish a re-positioning of the components as will be described in more detail below to alter the valve characteristics during camshaft rotation.

With continued reference to FIG. 2, the components will now be described in more detail followed by the operation of a first embodiment of the valve train control device 100. The camshaft 112 may be secured using conventional techniques and is driven conventionally as well by chain or belt, or other conventional means and is responsive to the engine speed as determined by gas pedal position or an electronic sensor and signal. Projecting from the camshaft is one or more of the primary cam lobes 110 (an exemplary one of which is shown in FIG. 2). The centerpoint 192 of the camshaft depicts the centerline axis of the camshaft projecting out of the page as viewed in FIGS. 2, 6, and 8. Such cam lobes are typically machined out of the camshaft or cast along with the camshaft as would be understood for one of ordinary skill in the art. For a system incorporating the present valve train control device 100 according to this exemplary embodiment, the selected cam lobe profile will most likely be selected from a profile having a relatively longer duration (and also probably lift) for accommodating more torque and horsepower at higher RPM with the auxiliary motion transfer device 120 disengaged (or in neutral) but with the auxiliary motion transfer device being selectively engageable or responsive to one or more engine operating parameters to provide the good idle and high torque characteristics at low and moderate RPM by reducing valve duration as will be explained below.

Figure 3:
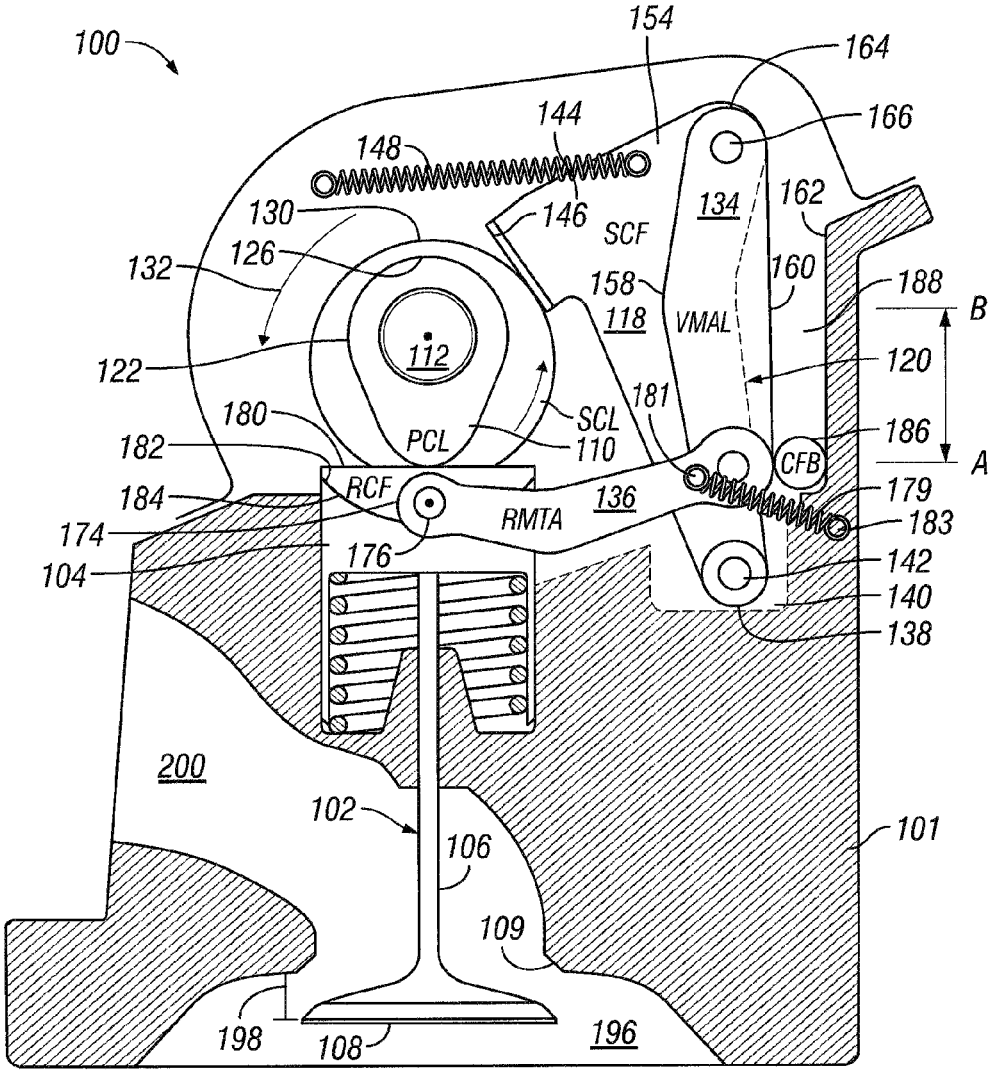
FIG. 3 is a similar view to FIG. 2 further advanced in the rotational cycle with the valve at the maximum lift position.
Figure 5:
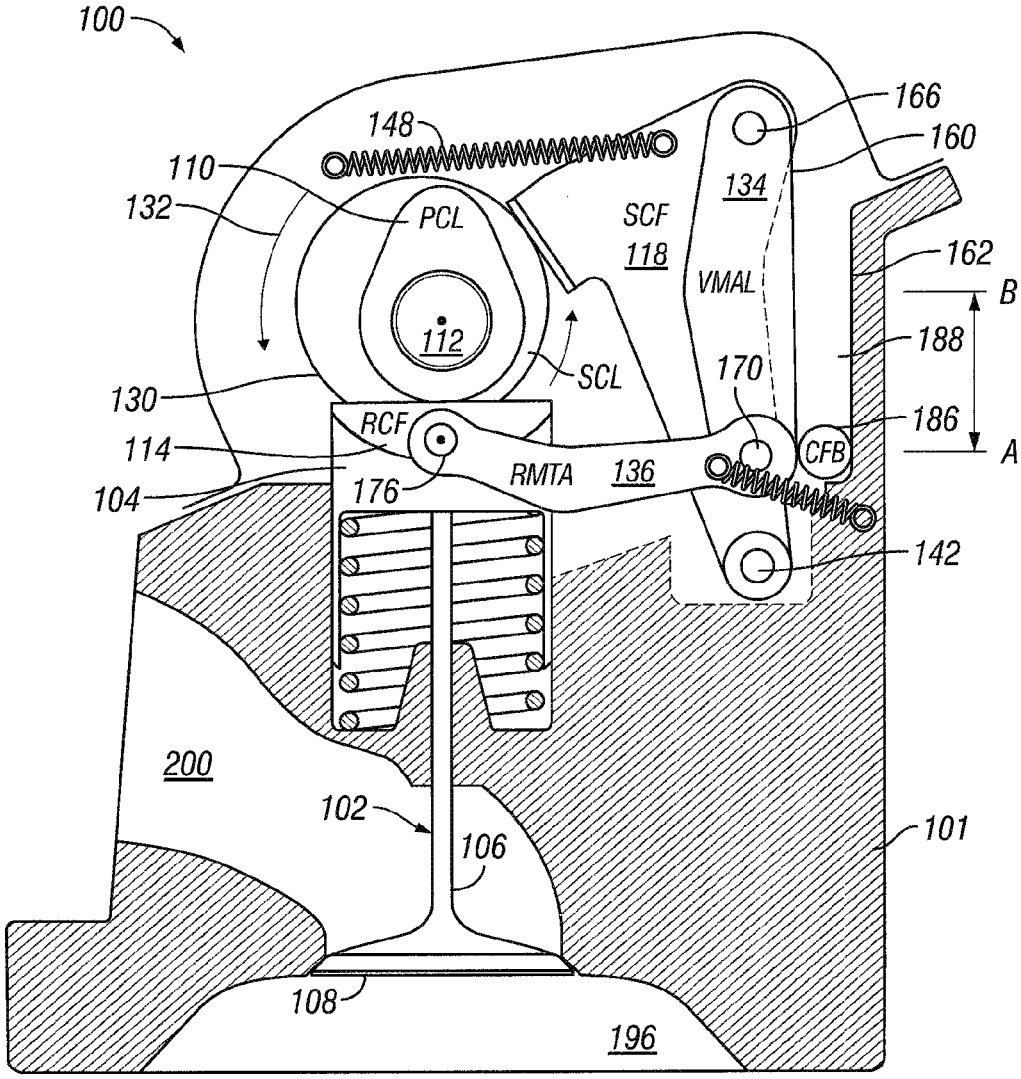
FIG. 5 is a similar view to FIG. 4 further advanced in the rotational cycle with the valve closed.

With continued reference to FIGS. 2 and 3, the elongated camshaft 112 includes a primary cam lobe 110 selected in this example for a high duration profile commonly used at higher end RPMs to provide more torque and horsepower. The primary cam lobe includes a peripheral working surface 122 in the form of a conventional ovoid shape profile with a maximum lift region including a relatively narrow end or nose 124 and an opposing broad end or base circle 126 present in the no lift region of the cam lobe. Opposing outer curved edges **128*a* and 128*b* or flanks with gentle radius of curvature or even flat regions connect the nose to the base circle regions. Together, these sections form the cam profile or external peripheral working surface 122 of the cam lobe. The tip of the narrow end 124 of the primary cam lobe provides for a maximum duration and lift scenario (FIG. 3) when perpendicular to the uppermost central planar following surface 180 (FIG. 3) of the primary cam follower 114 (FIG. 2) discussed below. At the other extreme, the extreme most region of the broad end 126 or base circle of the primary cam lobe 110 defines a fully seated valve position as shown in FIG. 5. The primary cam lobe provides a fixed duration profile, preferably for higher end RPMs to provide a higher than normal power lift/duration curve and when the mechanical linkage 120** described below is not engaged performs as it would in a conventional engine.

With continued reference to FIGS. 2-3, the secondary cam lobe (SCL) 116 projects outwardly from the camshaft 112 at a position adjacent or proximate to each primary cam lobe (PCL) 110 along the camshaft provided that the SCL does not interfere with the primary cam follower 114 or valve assembly. The outer peripheral surface 130 of the secondary cam lobe provides a contact point for the secondary cam follower (SCF) 118 described below. In this exemplary embodiment, the secondary cam lobe rotates in the same direction as the primary cam lobe and camshaft as indicated by the directional arrow 132. It will be appreciated that either cam lobe may be mounted on, cast from, or machined onto the camshaft using conventional techniques.

In this exemplary embodiment, the shape of the SCL 116 appears close to a circular eccentric and is shown larger than the primary cam lobe 110 in FIGS. 2-13 with the profile of the primary cam lobe (PCL) completely positioned within the profile of the SCL as shown in FIGS. 2-13. The intent of this depiction is to provide clarity of the elements of this embodiment rather than design necessity. However, the SCL may need to be shaped to provide the correct equivalent radial velocity and position dynamics required for the primary cam follower (RCF/PCF) 114 during PCL lift and fall to compensate for all the dynamics of the intermediate components described below. The overall size of the SCL compared to the PCL is unrelated.

The rotating secondary cam lobe 116 for each primary cam lobe 110 cooperates with the auxiliary motion transfer device 120 to alter the duration of the corresponding PCL 110 actuated engine valve 102 as will be described below. This secondary cam lobe (SCL), is offset along the camshaft from and angularly phased to its primary cam lobe (PCL) 110 such that the SCL 50% lift point matches the PCL 100% lift point in relationship to their respective cam followers, in the direction of camshaft rotation 132.

With continued reference to FIGS. 2-5, the auxiliary motion transfer device 120 coupling the secondary cam follower 118 to the primary cam follower 114 (RCF) is in the form of a mechanical linkage in this exemplary embodiment. This linkage 120 generally includes a variable mechanical advantage lever (VMAL) 134 pivotally coupled to an end of the generally hammer-shaped secondary cam follower opposing the secondary cam following surface 146 and further pivotally coupled to one end of a reciprocating motion transfer arm (RMTA) 136 which is in turn coupled at its distal end to the primary cam follower (RCF). In operation, the RCF translates the circular motion of the camshaft and associated primary cam lobe into linear reciprocating motion of the valve 102 regardless of orientation and in accordance with the primary cam lobe profile as modified by the auxiliary motion transfer device. This linkage 120 is selectively positionable as determined by a principal change in engine operating conditions, for which variable valve open duration is advantageous, including a change in RPM or other major engine operating parameters such as throttle position and manifold vacuum. Air temperature and pressure have a smaller effect on engine operating conditions and may be employed as signals for valve open duration adjustment to alter the position of the primary cam follower relative to the primary cam lobe 110 thereby altering the valve duration and/or timing characteristics during operation. The linkage 120 may be disengaged or placed in a neutral position, during which the primary cam lobe interacts with the valve as in a conventional valve train, or engaged at one or more variable positions, during which the primary cam lobe interacts differently with the primary cam follower thereby impacting the associated reciprocal valve movement. These components will be described in more detail below.

Continuing with FIGS. 2-5, the secondary cam follower (SCF) 118 is the follower for the secondary cam lobe (SCL) 116. The SCF is generally hammer shaped with an elongated end 138 pivotally restrained to the cylinder head 101 that may be scalloped out to provide a recessed region 140 for pivotally anchoring the SCF using a pivot pin 142 secured to the cylinder head. Other securement means will occur to one of ordinary skill in the art. Thus, the SCF may pivot about a bearing point along its bottom extent. The opposing enlarged end 144 includes a solid flat machined surface 146 forming a secondary cam lobe following surface. It will also be appreciated that this secondary cam lobe following surface may be a roller follower or rotating disc replacing the solid flat machined surface.

To bias the following surface 146 of the SCF 118 toward and against the peripheral working surface 130 of the secondary cam lobe 116, a spring or other biasing element may be introduced. In this exemplary embodiment, a representative follower biasing spring 148 is anchored at one end 150 to the cylinder head 101 and at the opposing end 152 to the upper end 154 of the SCF. This follower spring assists in maintaining the SCF following surface 146 in constant contact with the peripheral working surface 130 of the secondary cam lobe 116 during operation. It will be appreciated that the spring designated 148 may be replaced by other elements of sufficient force to maintain the SCF in constant contact with the SCL. For example, a torsion bar or leaf spring may be positioned to abut the rear edge 156 of the SCF to bias the SCF into contact with the SCL.

As an alternative, a "no-spring" version (not shown) of the SCF 118 would "require the SCF to be a connecting rod between the circular eccentric SCL 116 and the top end of the VMAL 134 discussed below. This configuration trades the addition of another component for the removal of the spring. The top of the VMAL still needs to be structurally supported and may be supported via a version of the pivoted SCF described above, minus the cam follower portion, or a translating member in a machined groove within the cylinder head. It will be appreciated that the "no-spring" version of the SCF 118 would require a circular SCL 116, offset from the camshaft centerline, designated 192 in FIG. 2, basically a crankshaft throw. However, this type of configuration would negate being able to customize the shape of and subsequent specific motion induced into the system components by the SCL. This is the extent of required changes for a spring-less SCF.

Attached to the SCF 118 is the variable mechanical advantage lever (VMAL) 134. In general terms, the VMAL 134 is a motion transfer lever including a peaked front edge 158 (for adding structural rigidity to avoid bending during high forces with the control fulcrum bar 186 discussed below directly behind it) and an opposing straight rear edge 160 aligned opposite a portion of the cylinder head wall 162 that forms a reaction surface explained further below in conjunction with the control fulcrum bar (CFB) 186. The top end 164 of the VMAL is pivotally coupled to the top end 154 of the SCF 118 by a pivot pin 166 while the bottom end 168 of the VMAL is pivotally coupled to one end of the reciprocating motion transfer arm (RMTA) by pivot pin 170. An alternative to this configuration may incorporate a spring imparted torque that is necessary to maintain both contact between the SCL and SCF and maintain the VMAL against the control fulcrum bar 186 discussed below. Individual springs for the other components may be used instead. It will be appreciated that the spring components shown in the figures are for ease of description and may be located at alternate locations, have alternate anchor points or anchoring means, or replaced with an alternative suitable biasing means including any described herein.

Still referring to FIGS. 2-5, the reciprocating motion transfer arm (RMTA) 136 may be used to transfer the motion at the bottom end of the VMAL 134 to the primary cam follower or rocker cam follower (RCF) 114 (FIG. 2). This reciprocating motion transfer arm 136 may take several forms. In this exemplary embodiment, the RMTA includes a single, elongated, transfer arm with a first end 172 (FIG. 2) pivotally coupled to the VMAL via pivot pin 170. The distal or downstream end 174 (FIG. 3) of the RMTA is disposed near the saddle region 104 (FIG. 2) and is pivotally coupled to the primary cam follower 114 via pivot pin 176. The pivot pin 176 allows the primary cam follower to pivot relative to the distal end of the RMTA so that the primary cam follower is a rocker cam follower (RCF). In this exemplary embodiment, the RMTA 136 may be biased toward a cylinder head wall 162 (FIG. 3) by a tension spring 179 anchored at one end 181 to the RMTA near the pivot pin 170 and to the cylinder head wall at a point 183 to the right of the cylinder wall surface 162. In operation, the RMTA 136 transfers the motion imparted to it by the VMAL 134 at pin joint 170 to the rocker cam follower (RCF) 114.

Figure 8:
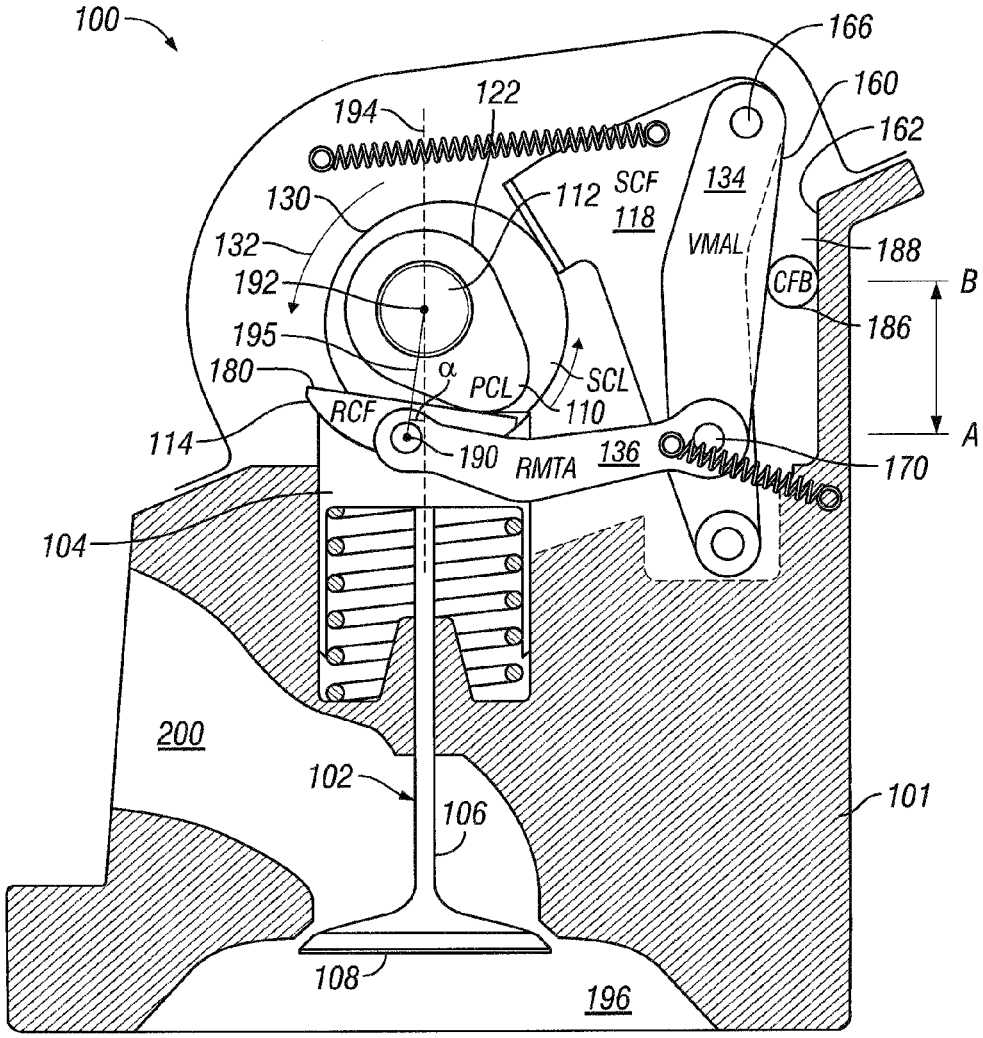
FIG. 8 is a similar view to FIG. 7 further advanced in the rotational cycle with the valve returning to the closed position.
Figure 9:
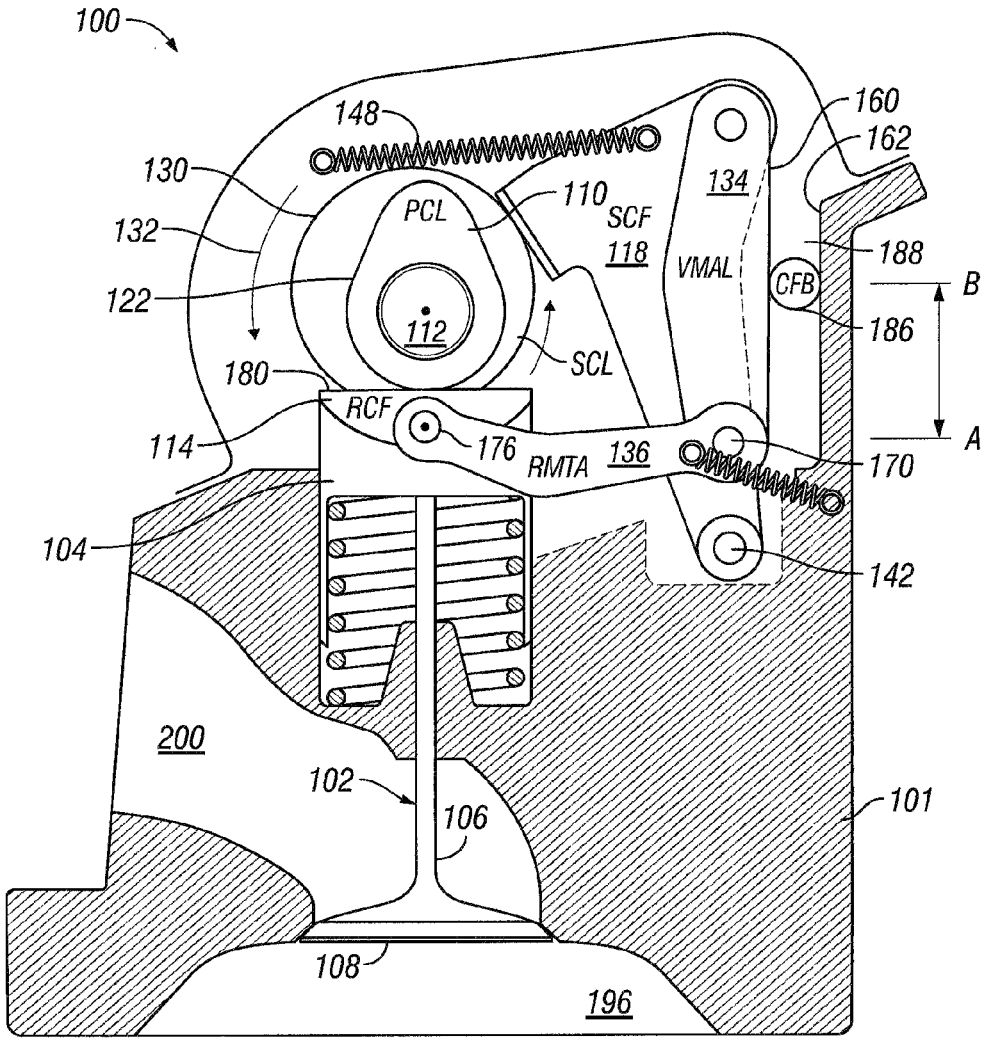
FIG. 9 is a similar view to FIG. 8 further advanced in the rotational cycle with the valve closed.

Should a single RMTA be used and positioned in a slot centered within the underside of the RCF 114, a bend 178 (FIG. 2) may be designed to prevent the RMTA from protruding through the cam follower surface 180 during extreme leftward motion coupled with downward travel of the RCF as viewed in FIG. 8, for example. The RMTA 136 may also consist of two or more straight (in end view only) arms, each pinned to the RCF at the sides, avoiding the follower surface 180. The RMTA could also be a single forked unit or other suitable linkage coupled to the RCF.

The rocker or primary cam follower (RCF) 114 includes an upper planar primary cam following surface 180 and an opposing arcuate sliding surface 182. The primary cam following surface 180 of the primary cam follower or rocker cam follower (RCF) 114 rides against the peripheral working surface 122 of the primary cam lobe (PCL) 110 as its cam follower. The RCF rides atop the modified bucket style follower in the form of a saddle 104 that includes a concave upper surface 184 that complements the convex arcuate surface 182. The lower region 187 (FIG. 2) of the saddle 104 forms a spring retention chamber 189 (FIG. 2) for retaining a valve spring 185 that biases the valve toward a closed position as shown in FIG. 2 and is typical of such configurations. The RCF 114 is the new follower on the primary cam lobe (PCL) 110. In other words, the RCF is the new upper portion added to the original "bucket" configuration primary cam lobe follower. The RCF rides on a concave surface 184 in the lower portion of the new "bucket". Motion of the RCF should be equivalent to the rotational velocity relationship of a normal cam follower to its cam lobe as the radius of the follower surface changes from the camshaft axis due to lift of the cam lobe.

The RCF 114 is connected to, and has additional motion induced by, the RMTA 136 at pin joint 176. In operation, the RCF 114 transforms rotating motion of the PCL 110 into reciprocating motion for the respective cam lobe's engine intake or exhaust valve 102. This additional motion induced to the RCF by the RMTA starts as very close to linear reciprocating, basically 90 degrees to that of the valve it is actuating. But since the RCF rides on a concave surface 184 formed by the saddle 104, the axis of which is parallel to the camshaft, the motion ends up as rocking in an arc. Given the motion of the primary cam follower 114, the rotational reciprocating motion of the valve train control device 100 described herein is also referred to as "rocking" of the primary cam follower herein. This rocking motion occurs at the same time the PCL is inducing linear reciprocating motion to the valve. The rocking motion is counter-rotating to the camshaft while the PCL is inducing valve lift via the RCF, thus making the result at the valve appear as though the PCL is rotating faster. The SCF rotates in the same direction as the camshaft while the PCL heel is in contact with the RCF, thus having no effect on the valve 102 while resetting itself for the next cycle. The rocking motion imparted to the RCF by opposing end 172 (FIG. 2) of the RMTA near pin joint 170 is shown by arrows 199 in FIG. 6 while the reciprocal motion of the valve is shown by arrows 197 appearing on the valve stem 106 in FIG. 6 as well. The axis of the concave saddle surface 184 between the RCF 114 and the saddle region 104 below, which provides the radius of rotation about the camshaft for the RCF, must match the axis of the camshaft when the RCF is on the heel 126 of the PCL 110. This is necessary for the "return" rocking motion of the RCF on the PCL heel without inducing motion into the valve.

It will be appreciated that the interfacing surface of the RCF 114 to the PCL 110 is shown flat (classic "solid" lifter style) here for simplicity. The surface could also be convex or a roller, as individual design approach would dictate. It will be further be appreciated that in conventional valve trains, some "bucket" followers rotate as well as provide for valve lash adjustment. For example, a rotating disc is an alternative embodiment of the flat surface to ensure the wear between the cam lobe and cam follower is uniform. These provisions can also be accommodated within the valve train control device 100.

Still referring to FIGS. 2-5, to selectively and variably control the position of the linkage 120, a control element or controller in the form of a variable position control fulcrum bar (CFB) 186 is provided. The CFB is the component that controls how much motion, if any, the primary cam follower (RCF) 114 attains through all the interconnected components (SCF 118, VMAL 134, and RMTA 136). The CFB may be in the form of a cylindrical rod and is common to all VMALs along a row of valves 102, acting as a single fulcrum for each of the VMALs. The CFB may be a simple single component or a bar with a roller at each VMAL and CFB reaction surface 162 contact. The CFB is located in a control gap 188 between the reaction surface 162 of the cylinder head and the rear edge 160 of the VMAL and remains in contact with both due to the biasing spring element 179 that biases the VMAL toward the CFB.

With continued reference to FIGS. 2-5, the VMAL 134 pivots on a fulcrum that is variable in its position versus the length of the VMAL. The CFB 186 provides the fulcrum. The lower end 168 of the VMAL experiences various amounts of motion (from engineering maximum to zero) depending on the position of the CFB along the length of the VMAL. It will be appreciated that the CFB reaction surface 162 is shown flat and fixed in FIGS. 2-13, but could be shaped otherwise or moveable depending upon desired further variation in valve timing discussed herein. In this exemplary embodiment, the horizontal centerline of the CFB (line projecting through position A) is aligned with the horizontal centerline passing through the pinned joint between the VMAL and the RMTA (generally shown by arrows 199 in FIG. 6). This position of the CFB is the "zero" motion (or neutral or disengaged) position, labeled A in FIGS. 2-5.

As an alternative, the spring (or spring equivalent) 179 may be omitted if the CFB 186 is captured within the VMAL 134, as, for example, in a slot matching the CFB diameter, the CFB may only require an adjustment in design from the previous non-captured configuration to allow its installation into all the slotted VMALs. In order for this captured version to operate properly, the CFB must ride in a slot (not shown) in the cylinder head 101 requiring an opposing surface to reaction surface 162 so that the CFB is fully captured in the force direction and allowed to translate vertically, exerting its intended control of the VMAL.

Figure 6:
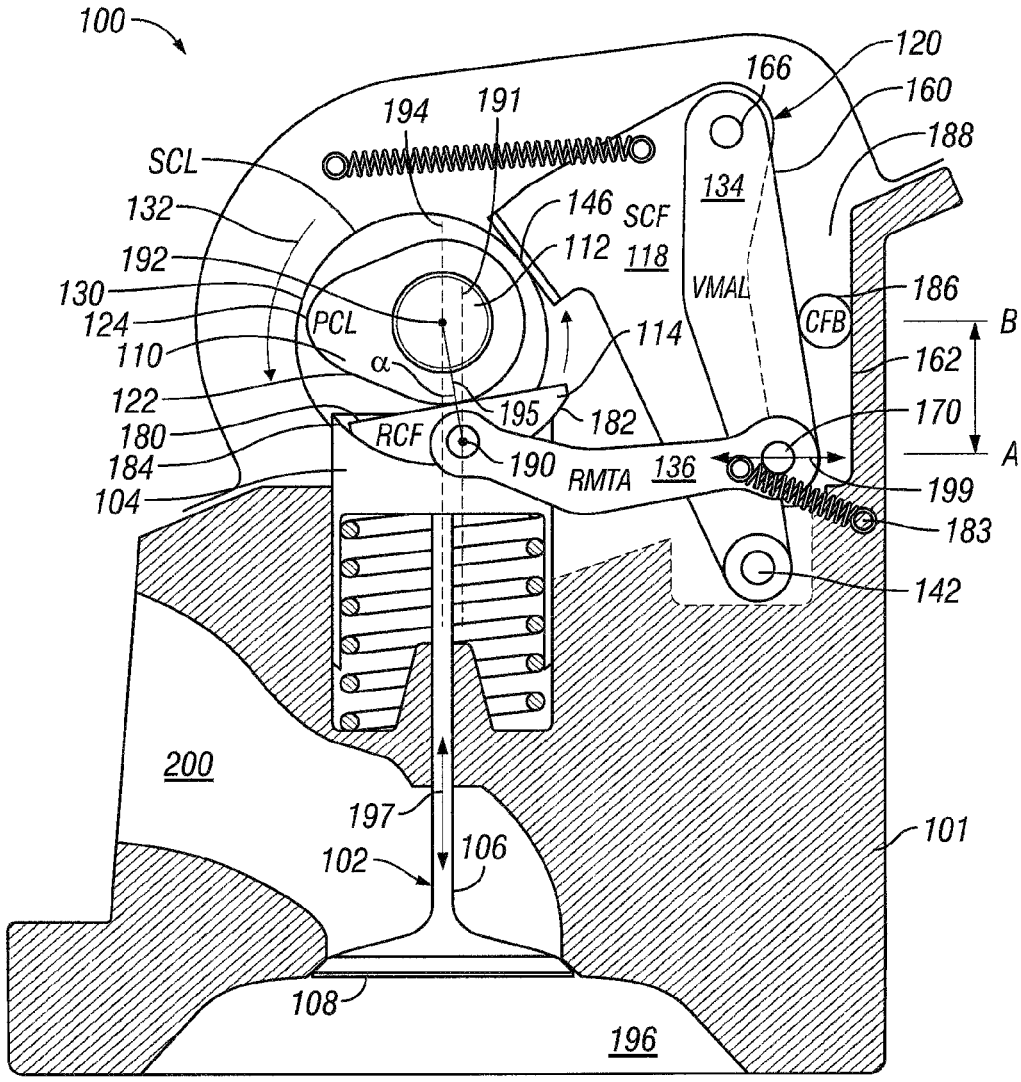
FIG. 6 is a similar view to FIG. 2 with the valve train control device engaged at a maximum position B and the corresponding valve in the closed position.

The CFB 186 is selectively positionable from a lowermost point, designated A, shown in FIG. 2 as projecting through the centerline of the CFB, to an uppermost point, designated B, shown in FIG. 6 as projecting through the centerline of the CFB, and all points therebetween, designated C as for example in FIGS. 10-13. At position A, there is infinite mechanical advantage through the VMAL 134 to the RMTA 136, thus essentially no motion transfer through the VMAL from the SCF 118 to the RCF 114. An extremely small (essentially negligible) amount of motion may be imparted due to the radial motion and the differences in radius for the parts involved.

Figure 7:
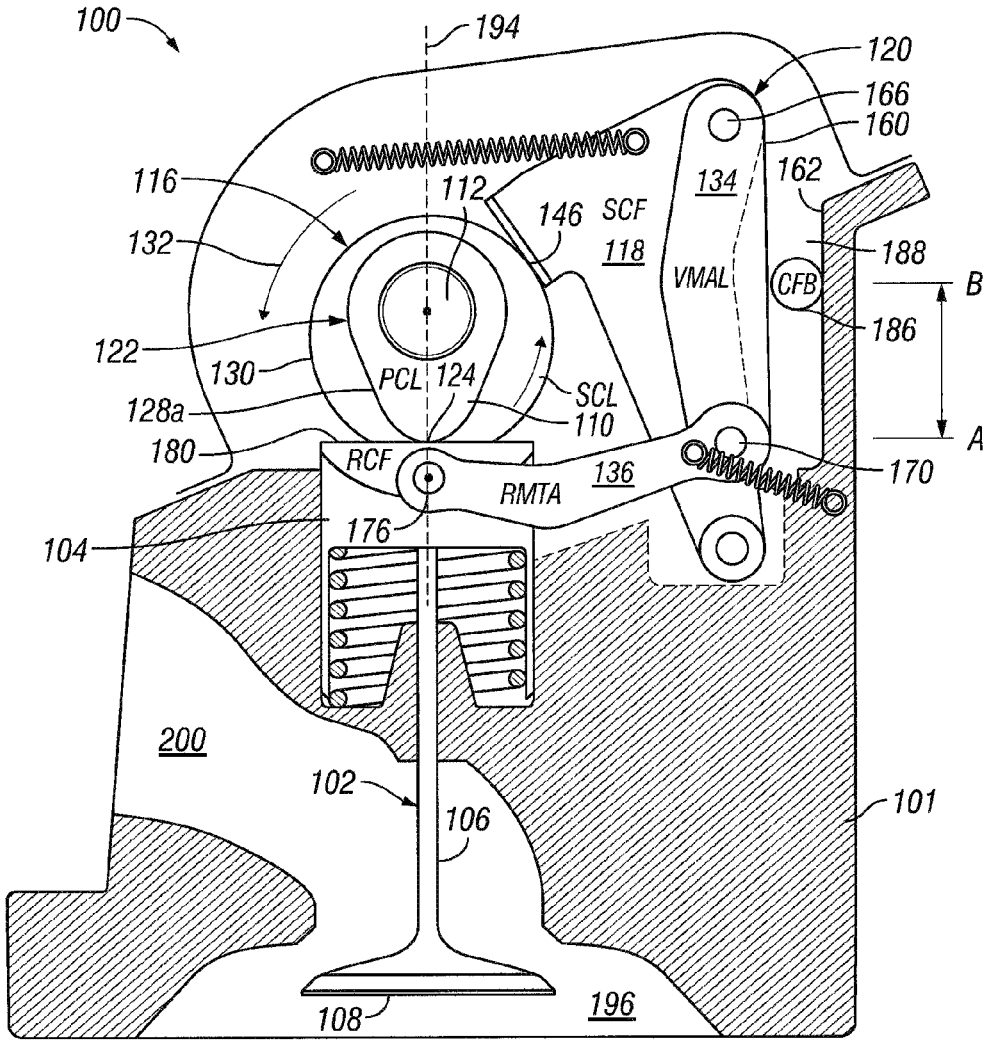
FIG. 7 is a similar view to FIG. 6 further advanced in the rotational cycle with the valve at the maximum lift position.

In this exemplary embodiment, at its highest point B as in FIG. 6 or 7, the CFB 186 is aligned approximately midway between the pinned joints 166 and 170 of the VMAL 134. At this position it provides the lowest mechanical advantage and maximum motion transfer from the SCF 118 to the RCF 114. It will be appreciated that moving the CFB further upward would induce more motion with less mechanical advantage but forces on the components may start becoming excessive and less than desirable durability achieved.

Figure 10:
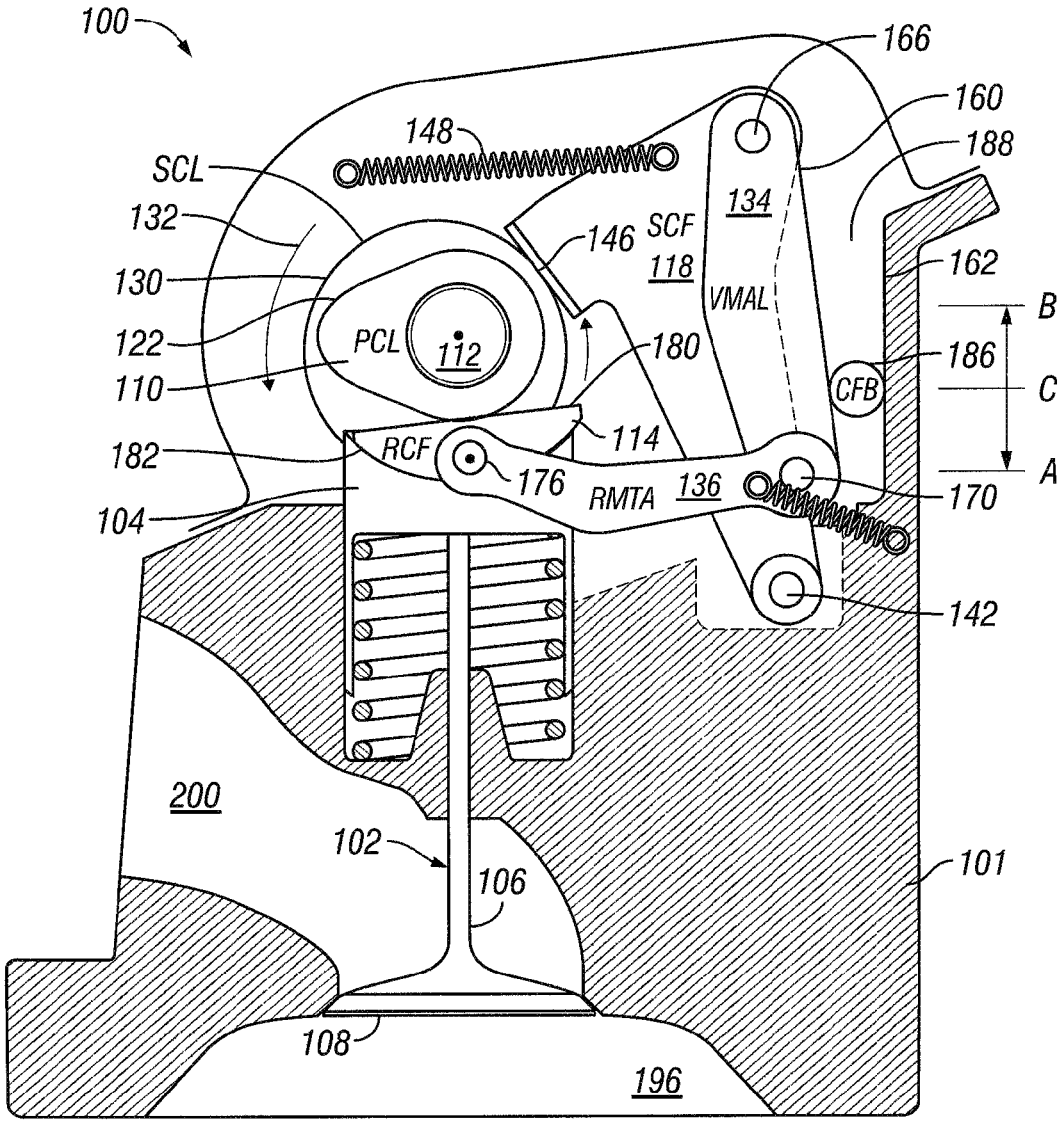
FIG. 10 is a similar view to FIG. 2 with the valve train control device engaged at an intermediate position C and the corresponding valve in the closed position.
Figure 11:
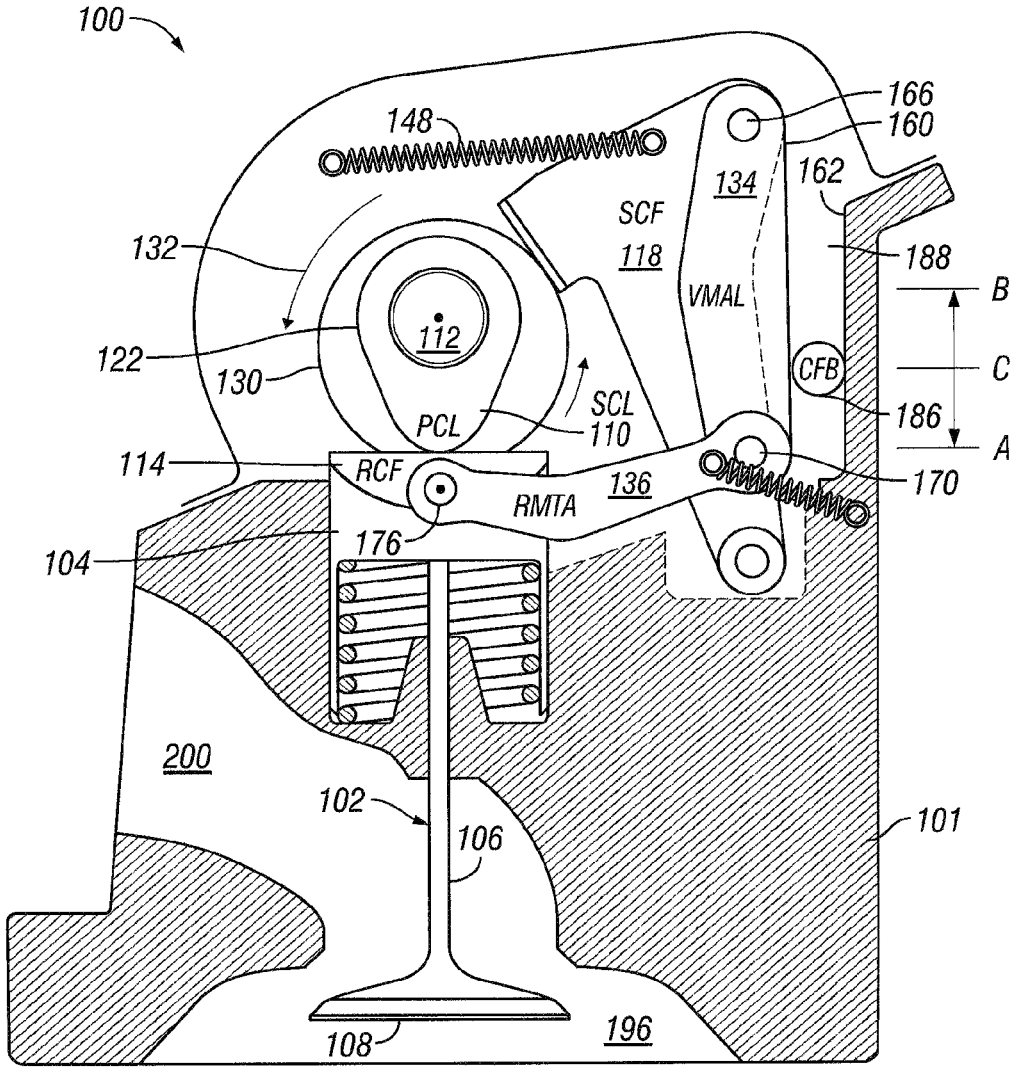
FIG. 11 is a similar view to FIG. 10 further advanced in the rotational cycle with the valve at the maximum lift position.

As an illustration of an alternative CFB 186 position between the minimum point A and maximum point B, intermediate point C is shown in FIG. 10 with the centerpoint of the CFB aligned at point C below the midway point between the pinned joints 166 and 170 of the VMAL and nearer to the lowermost point A in this exemplary embodiment. Use of the valve train control device 100 at all three of these exemplary control points A, B, and C will be explained in more detail below but it will be appreciated that the CFB may move through the entire range from A to B and all points in between.

Another alternative is possible with the fully captured VMAL 134 and CFB 186. If the VMAL extended beyond the VMAL to RMTA pin joint 170, and the CFB could be positioned in this lower extended area, motion at the RMTA and RCF would reverse the reciprocating motion direction compared to that with the CFB at and above position A. This would add to the PCL 110 duration instead of subtracting it. This could be a decided advantage if the PCL profile were optimized around freeway cruise RPMs and a little above, where the majority of the time at RPM is spent. This would allow a little more duration to be added for the higher end of the RPM spectrum that is proportionally used very little. This configuration requires the fully captured VMAL and CFB due to the force vector reversals as the CFB transitions through the zero-motion position A.

Positional control of the CFB 186 is to be determined by engine parameters, RPM being the priority, and may be accomplished by any number of separate methods. It must, however, remain parallel in its motion as it moves between positions A and B. Motion/positional control of the CFB based on engine parameters would be understood by one of ordinary skill in the art.

The CFB 186 is backed by a smooth reaction surface 162 (FIGS. 2-13), or other components, that provide a planar motion for the CFB as it varies its control position. It provides the force reaction imparted by the VMAL 134 to the CFB 186. In FIGS. 2-13, the smooth reaction surface is shown as a fixed machined surface of the cylinder head. If motion of this surface is desired then additional parts and motion control are necessary. A planar surface is envisioned for the sake of machining and engineering simplicity. It is not beyond comprehension that a circumstance could arise where a non-planar reaction surface shape would be desired.

Variable adjustment, normal to the plane of the reaction surface 162 itself would provide advance or retard phase changes for the Primary cam lobe. A single variable "backup" surface for a SOHC configuration (one row of valves and a single CFB) could vary the cam timing phase. This scheme for a DOHC configuration, an independent surface for each set of intake or exhaust valves and two CFBs, would add variable "lobe center" capability to the engine.

If fully captured VMALs 134 and CFBs 186 are used, the CFB reaction surface 162 would require added components to counter the force vector of the CFB away from the primary reaction surface 162.

A reaction surface (or equivalent component design) 162 may not be required if the CFB 186 itself is stiff enough to resist bending (of an unacceptable amount) along its length due to the forces imposed by the VMALs 134, and the CFB motion and positions can be adequately controlled.

Whether the RCF 114 "rocks", and how much or not depends on the position of the CFB 186. The CFB at position A shown in FIGS. 2-5 provides essentially no motion at the RCF (yielding an RCF with its cam follower surface essentially remaining at 90 degrees to the valve stem). The CFB at position B shown in FIGS. 6-9 provides the most motion. The CFB may be positioned anywhere between positions A & B such as position C as shown in FIGS. 10-13. This provides a thoroughly variable amount of degrees of duration that are subtracted from the machined PCL 110 duration.

It will be appreciated that dynamics of the moving parts is not a problem. The valve train control device 100 subtracts duration with its motion. The more motion, the shorter the duration at the valve becomes. With the rocking motion being variable, the maximum rocking motion provides the shortest duration at the valve, and that is desired at the lowest engine RPM (idle). As RPM goes up, rocking motion becomes less, eventually becoming zero and subtracting no duration timing from the machined PCL 110 duration. The "design RPM" at which this zero rocking motion takes place allows very mild dynamics for the involved components compared to normal engine valve trains. This allows mild spring forces and loads on the pinned joints.

Referring now to FIGS. 2-3, depending upon the configuration approach, springs will or will not be utilized. This can occur at either of two places, and independently of each other. In this exemplary embodiment, there are several springs including at least two auxiliary motion transfer device (linkage) 120 related springs, the SCF biasing spring 148 and the VMAL/RMTA biasing spring 179.

No springs would be required if a fully captured SCF 118 (or equivalent), VMAL 134, and CFB 186 are used. An exemplary no-spring SCF may be a "connecting rod", the big end rotating around a circular eccentric version of the SCL 116 and connected at the other (small) end to the VMAL. A fully captured VMAL would have a slot that the CFB rides in, being the same width as the CFB diameter. The slot prevents the VMAL from pulling away from the CFB as the RCF, connected to the VMAL by the RMTA 136, rides down the receding slope of the PCL. The CFB, now having a force on it by the VMAL that would pull it away from the CFB reaction surface 162 by the VMAL, would also require being captured. This may be accomplished by applying several strips along the CFBs length, parallel to the CFB reaction surface and offset from it by the diameter of the CFB.

The preference for using springs arises if it were desired to have a SCL 116 that is other than perfectly circular. For example, the SCF 118 must be spring-loaded against the SCL. The SCF will have low reciprocating mass (moment of inertia) and the SCL's profile will be low acceleration, so the spring force will be appropriately low.

Figure 4:
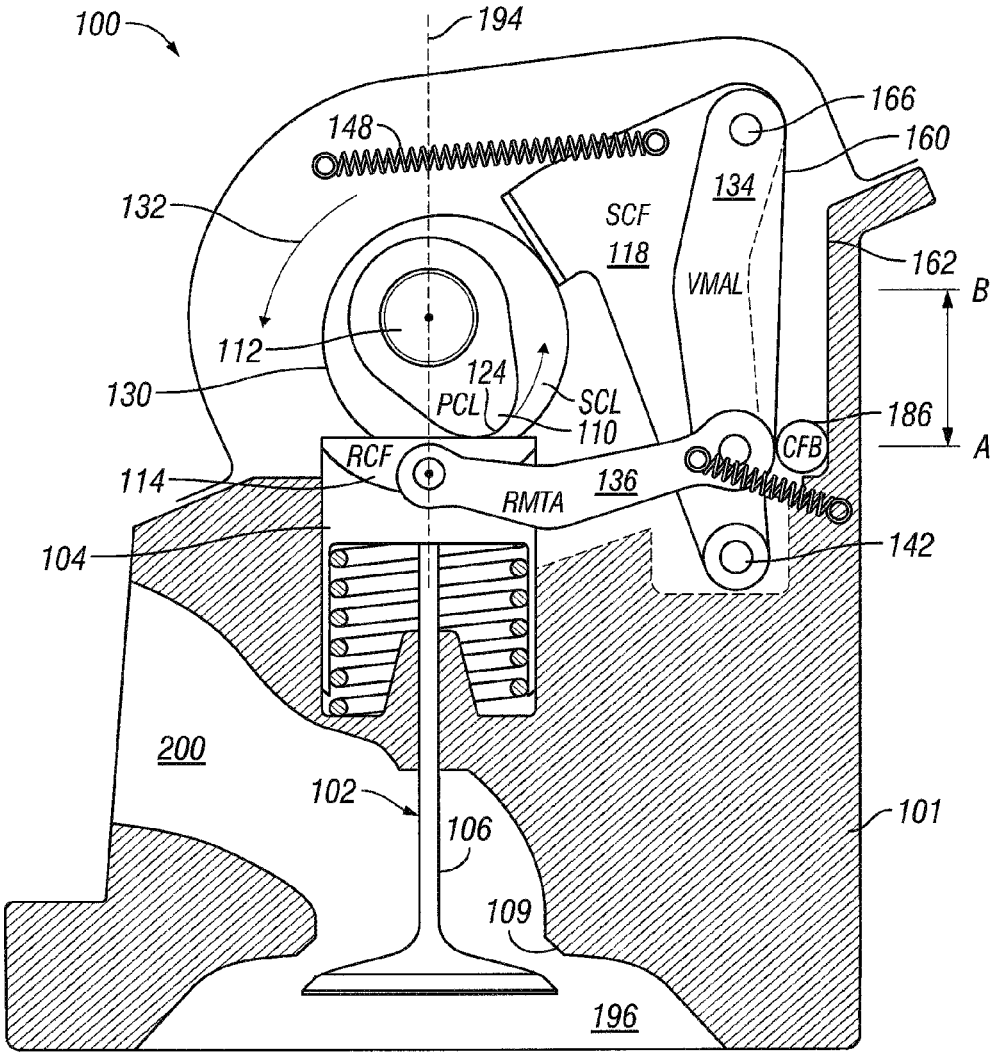
FIG. 4 is a similar view to FIG. 3 further advanced in the rotational cycle with the valve returning to the closed position.
Figure 12:
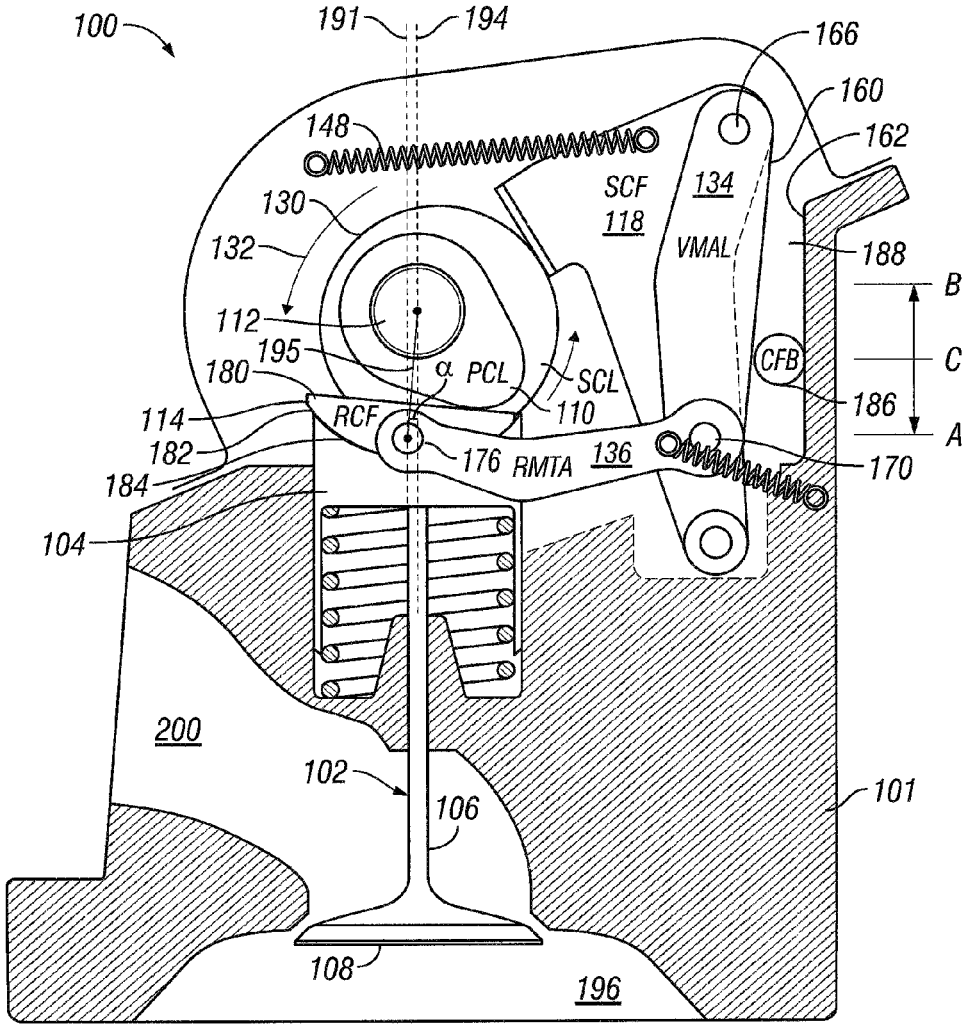
FIG. 12 is a similar view to FIG. 11 further advanced in the rotational cycle with the valve returning to the closed position.
Figure 13:
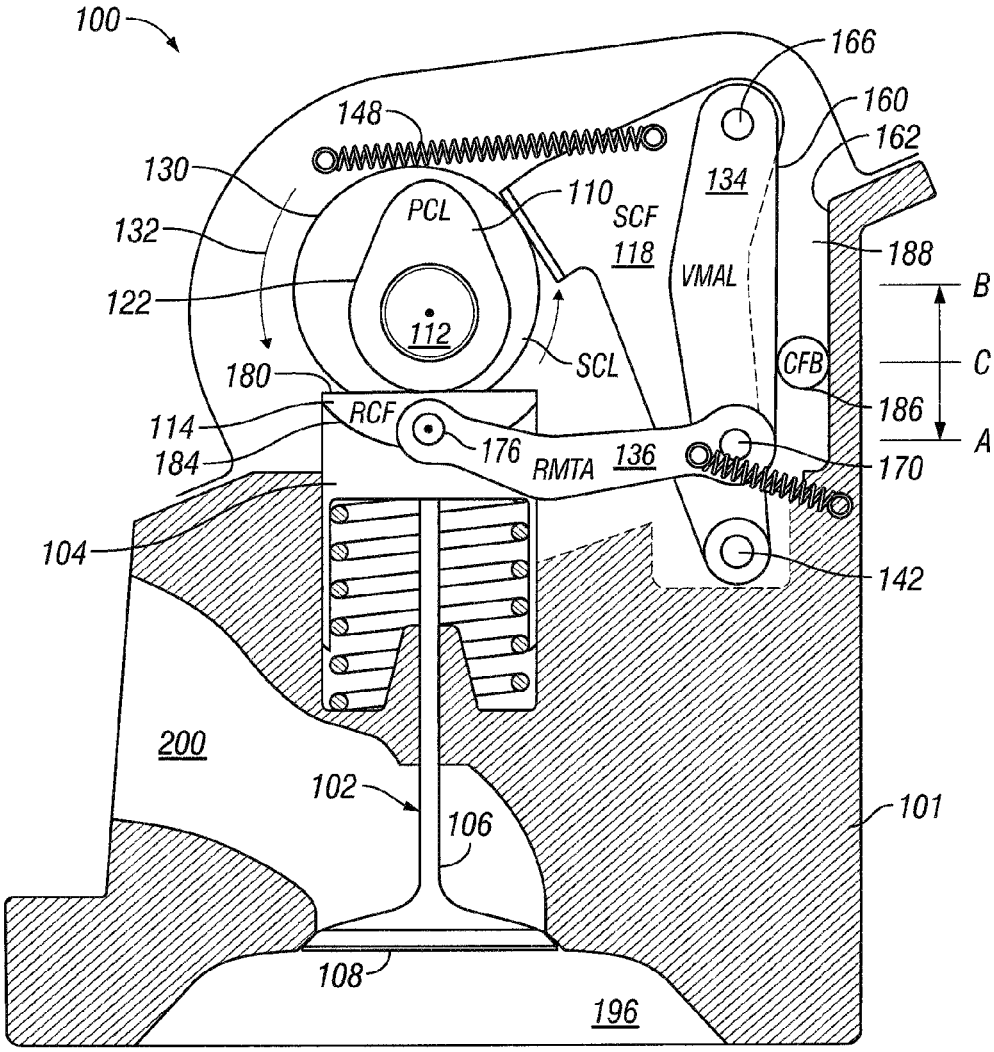
FIG. 13 is a similar view to FIG. 12 further advanced in the rotational cycle with the valve closed.

In the spring configuration, the VMAL 134 must also be spring-loaded against the CFB 186. The mass here, contributed to by variable portions of the VMAL plus the RMTA 136 and the RCF 114 is more significant. The primary purpose of this spring force is to return the system components (VMAL, RMTA, and RCF) to their beginning position in the reciprocating motion during the "PCL Heel" 126 (shown in FIGS. 2 and 3) rotation period. An additional factor is when the RCF is on the valve closing, or receding side, of the PCL as shown in FIGS. 4, 8, and 12. Valve spring force coupled with the slope of the RCF/PCL contact in a very low friction environment will tend to induce a "ride down the slope", pulling the VMAL away from the CFB. These factors will drive an increase in spring force for this group of components.

In this exemplary embodiment, it is assumed that a high duration primary cam lobe profile has been selected. Referring now to FIGS. 2-5, the normal, non-variable operation will now be described. During normal operation, the CFB 186 is positioned in the disengaged or non-engaged position as indicated at A in the figures. In this exemplary embodiment, the non-engaged position is shown with the centerline of the CFB at the A line. This position establishes the centerline of the CFB in line with the centerpoint of the pin joint 170. Essentially, in this disengaged position with the CFB positioned at or near the lowermost extreme of the slot 188, the RMTA length between joint 170 and joint 176 (with centerpoint 190) determines the RCF position at a zero motion condition. This results in the RMTA 136 and RCF 114 positioned in the normal position with the centerpoint 190 of the RCF aligned vertically with the centerpoint 192 of the camshaft 112 as indicated by dashed line 194 in shown in FIG. 2. It will be appreciated that this vertical alignment may be different in actual use due to a different normal orientation between the RCF and the camshaft and thus a different "normal" line 194 will be established. Effectively, this position allows the valve train system to operate as if only the conventional camshaft, primary cam lobe, and bucket style follower were being used.

As shown in FIG. 2, the entire camshaft 112 and accompanying primary cam lobe 110 and secondary cam lobe 116 are rotating in the counterclockwise direction as indicated by rotational arrow 132. In this configuration the flank 128*b* of the primary cam lobe 110 has not yet begun to lift the valve seat 108 from its closed position to allow air from the intake 200 to enter the combustion chamber 196 or if an exhaust valve, allow exhaust gases to escape the combustion chamber into the exhaust port 200. As the primary cam lobe continues to rotate counterclockwise as driven by the camshaft 112, the nose 124 of the primary cam lobe will reach the maximum lift position as shown in FIG. 3 thereby translating the rotational motion of the camshaft and primary lobe into linear motion of the valve 102 as would be readily understood by one of ordinary skill in the art. With the nose of the primary lobe in the maximum lift position (centerpoint of the nose vertically downward as in FIG. 3), the valve head 108 attains its maximum lift distance 198 into the combustion chamber 196 allowing air to continue entering the chamber (if an intake valve) or allowing exhaust gases to continue escaping (if an exhaust valve).

Turning now to FIGS. 2 and 4, the centerpoint of the nose 124 passes the centerline 194 of the primary cam follower 114 in the normal position and the valve head 108 begins its descent back toward the valve seat 109 and eventually winding up in a fully seated position as generally shown in FIG. 5 thereby closing off the airflow to the combustion chamber 196. The process repeats as the camshaft continues its counterclockwise rotation. It will be appreciated that through this valve lifting and closing process, the secondary cam lobe 116 remains in contact with the secondary cam follower 118 and imparts motion to the SCF. However, with the CFB in the disengaged position at the A line as shown throughout FIGS. 2-5, the linkage between the SCF 118 and the primary cam follower (RCF) 114 does not alter the valve characteristics of duration and/or timing since the pin joint 170 does not move and, in practice, a system incorporating the device 100 behaves as a conventional reciprocating piston internal combustion engine having a camshaft and primary lobe profile.

It will be appreciated that the secondary cam follower 118 rotates back and forth about its pivot point 142 due to the profile of the secondary cam lobe 116 throughout the camshaft 112 rotational cycle but because the CFB 186 is in a position at A to provide infinite mechanical advantage (or zero motion) to the VMAL 134, there is no impact from this SCF movement imparted to the primary cam follower 114.

Referring now to FIGS. 6-9, the valve train control device 100 may be actuated to induce a change during camshaft 112 rotation in at least one of the valve operating parameters (duration and/or timing). More specifically, the CFB 186 may be automatically or selectively moved, as determined by engine parameters, such as crankshaft speed RPM (camshaft speed being one-half that of the crankshaft) in conjunction with computer programming, or other desired triggering parameter, to an engaged position for the maximum impact as indicated at the B line in FIG. 6. As the selected triggering parameter is reached, the CFB may slide upwardly from the A line to the B line within the control gap 188 between the reaction surface 162 and rear edge 160 of the VMAL 134. As shown in FIGS. 6-9, the maximum position is represented with the centerline of the CFB at or about the B line in accordance with engineering calculations. Any point between A and B represents varying degrees of impact engagements. Only A represents minimum and B represents maximum in this exemplary embodiment.

Continuing with FIGS. 6-7, with the camshaft 112 rotating, the secondary cam following surface 146 of the secondary cam follower 118 continues to follow the peripheral working surface 130 of the secondary cam lobe 116. It will be appreciated that the shape of the secondary cam follower may be designed to compensate for the mechanical losses of motion created by the linkage components. As the CFB 186 slides upwardly into the maximum engagement position B, the cylinder head side surface of the CFB remains in contact with the reaction surface 162 while the VMAL side surface of the CFB remains in contact with the interior edge 160 of the VMAL.

As the position of the SCF 118 is determined by SCF follower surface 146 on the corresponding portion of the SCL working surface 130, this determines the position of the rocking pin joint 166 between the SCF and the VMAL 134. Furthermore, the position of the CFB 186 determines the fulcrum point for the VMAL by acting on the rear planar edge 160. At the instant in camshaft angular rotation shown in FIG. 6, with the CFB elevated to the B position in the control gap 188, the pinned joint 170 between the VMAL and RMTA 136 is shifted toward the cylinder head reaction surface 162 and further into the control gap 188 (FIG. 6). This movement of the pin joint 170 in the rightward direction as shown in FIG. 6 changes the angle between the rear edge 160 of the VMAL and the cylinder head surface 162. In turn, the newly positioned RMTA draws the center of the primary cam follower RCF 114, as represented by pin joint 190, off the centerline 194 of the camshaft 112 that coincides with the centerline of the valve stem 102 passing through the centerpoint 192 (FIG. 2) of the camshaft to a new position as represented by an offset centerline 191 (FIG. 6). This rightward motion of the RMTA as viewed in FIG. 6 displaces the primary cam following surface 180 of the RCF 114 from a horizontal configuration, as shown in FIG. 2 for example with the CFB 186 in the disengaged or neutral position, to a tilted position as shown in FIG. 6. It will be appreciated that FIGS. 6 and 7 illustrate an exemplary configuration occurring during a point in the angular rotation of the camshaft and that the components of the auxiliary motion transfer device 120 are generally rocking back and forth and/or translating up and down during the camshaft rotation in accordance with their positions at any point in the camshaft rotation.

To put another way, as pin joint 170 of the RMTA 136 moves to the end of rightward travel, the RCF 114 rotates on and about the center axis of pin joint 190 while sliding on the circular concave surface 184 to tilt the primary cam following surface 180 as viewed in FIG. 6 from the horizontal orientation shown in FIG. 2. As the pin joint 170 begins to translate to the left from its most rightward position as viewed in FIG. 6, the primary cam following surface 180 is rotated (FIGS. 7-8) counter to the rotation of the PCL 110 due to the curvature of the underlying convex slide surface 182 riding in the complementary concave upper surface 184 of the saddle region 104 atop the valve stem 106.

As one measure of motion of the RMTA 136 and RCF 114 at pin joint 190, in this exemplary embodiment and at a particular point in time during camshaft rotation, a variable angle $\alpha$ (FIG. 6) may be measured between a line 195 passing through the centerpoint 192 of the camshaft and the centerpoint of pin joint 190 relative to the centerline 194 that passes through the centerpoint 192 of the camshaft and projects down the centerline of the valve stem 106. This angle $\alpha$ may be measured to either side of the centerline 194 as shown in FIGS. 6 and 8 depending on the position of pin joint 190. It will be appreciated that the angle $\alpha$ taken as a snapshot in time during camshaft rotation as shown in FIGS. 6, 8, and 12 is for illustration purposes only and not meant to be limiting in any manner. In this exemplary embodiment, with the CFB 186 at position B, angle $\alpha$ varies between maximum extremes to the left or right of the centerline 194 (as viewed in FIGS. 6 and 8) during camshaft rotation as the centerpoint 190 of the RCF 114 moves back and forth across the centerline 194 due to RMTA motion and also up and down as the RCF interacts with portions of the primary cam lobe 110. At position B, the auxiliary motion transfer device 120 is engaged and maximum durational change (a reduction in this exemplary embodiment) is imparted on the valve 102 relative to the durational parameters defined by the primary cam lobe 110 profile. These maximum extremes of angle $\alpha$ are lessened, however, as the CFB moves from position B toward position A and thus valve duration is impacted to a lesser extent until, at position A, angle $\alpha$ is zero and no additional valve duration changes relative to those defined by the primary cam lobe profile are imparted by the auxiliary motion transfer device 120 since the auxiliary motion transfer device is effectively disengaged. Given the interaction of the variable orientation RCF and the PCL, it will be appreciated that the durational parameters of the valve 102 defined by the primary cam lobe profile may be modified by the position of the CFB as the camshaft 112 rotates. During engine operation, the movement of the CFB 186 is relatively subtle or miniscule while the camshaft 112 rotates at both low and high RPMs.

With continued reference to FIGS. 6-7, as the nose 124 of the primary cam lobe 110 approaches the now tilted primary cam following surface 180 in a counter clockwise motion about the centerpoint 192 of the camshaft 112, the rotating secondary cam lobe 116 drives the secondary cam follower 118 in a clockwise motion about its pivot point 142. With the CFB 186 at a set position B, the top end of the VMAL, driven by its connection 166 to the rightward moving top end of the SCF, also translates to the right. This results in the VMAL pivoting about the CFB acting as a fulcrum, such that the bottom end of the VMAL translates to the left back toward the camshaft centerline 194. Correspondingly, the VMAL/RMTA pivot joint 170 is driven back toward the camshaft centerline 194 to realign the pin joint 190 with the centerline 194 thereby reducing the duration the valve 102 is lifted from the closed, or seated, position to maximum lift as shown in consecutive views in FIGS. 6-9. During this motion of the RMTA and RCF from right to left as viewed in FIGS. 6-7, the primary cam following surface 180 slides or slips aided by a lubricating agent along the peripheral working surface 122 of the primary cam lobe 110.

As shown more particularly in FIG. 7, the nose 124 of the primary cam lobe 110 is pointed vertically downward in the max lift position. The RCF following surface 180 is also returned to a horizontal position (as viewed in FIG. 7) such that the maximum cam lift coincides with the RCF following surface at 90 degrees to the valve stem/camshaft centerline 194, regardless of CFB 186 position. As the primary cam lobe continues to rotate counterclockwise, the peripheral working surface 130 of the secondary cam lobe 116 drives the secondary cam follower 118 about its pivot point 142 and the CFB 186 acts as a fulcrum on the VMAL 134 to drive the pinned joint 170 beyond the centerline 194 of the camshaft 112. This reduces the duration the valve head 108 requires to transition from max lift to a fully closed position (FIG. 9), or in contact with the cylinder head valve seat for the entire single cycle.

It will be appreciated that throughout this process, the primary cam follower 114 moves in a rocking motion translating back and forth across the centerline 194 and tilting from the horizontal position while, at the same time, moving in a vertically reciprocating linear motion to in turn drive the valve stem 106 in a reciprocating linear motion. This motion is best seen comparing the RCF 114 and valve 102 positions throughout FIGS. 6-9. In addition, the linkage components of the VMAL 134, RMTA 136 and primary cam follower 114 rotate counter to the rotation of the primary cam lobe 110 for a portion of the camshaft rotation cycle and in the same direction for the remainder of the camshaft rotation cycle. Horizontal arrows 199 (FIG. 6) represent the back and forth of the RMTA 136 at pin joint 170. The rigid RMTA translates this back and forth motion to the RCF via pin joint 190. Vertical arrows 197 appearing on the valve stem 106 (FIG. 6) represent the reciprocating linear motion of the valve 102 as displaced by the motion of the primary cam lobe 110 interacting with the primary cam follower 114.

Referring now to FIGS. 10-13, the valve train control device 100 may be selectively actuated to induce an intermediate change at any point between the disengaged or neutral position A and maximum position B in at least one of the valve operating parameters (duration and/or timing). More specifically, the CFB 186 may be selectively moved, as determined by engine parameters, crankshaft speed, computer programming, or other desired parameter acting as a trigger, to an intermediate impact position as indicated, for example, the CFB 186 may shift to the C line in FIG. 10. As the selected triggering parameter is reached, the CFB may shift or slide upwardly from the A line to the C line within the control gap 188 between the reaction surface 162 and rear edge 160 of the VMAL 134 and remaining in contact with both opposing surfaces.

The operation of the valve train control device 100 with the CFB 186 in the C position is the same as for the device 100 with the CFB in the B position, except that the valve parameters changes are not as severe. The rocking motion of the auxiliary motion transfer device 120 (FIG. 2) is shown throughout FIGS. 10-13 wherein the RCF 114 is displaced to either side of the centerline 194 (FIG. 12) while also moving in a reciprocating linear direction to drive the valve 102 in a corresponding manner. The maximum extremes of angle α (FIG. 12) would not be as severe as when the CFB is in the B position. In other words, the reduction in the duration of valve opening is not as great as the reduction to the valve opening duration with the CFB in the B position. It will be appreciated, moreover, that the CFB may be positioned at any intermediate point between positions A and B thus arranging for an entire range of intermediate positions and a variable impact to the duration of the valve opening during the camshaft rotational cycle. By altering the position of the CFB from the A position of disengagement, wherein the entire system acts as a conventional valve train based on a selected lobe profile, to the maximum impact position B, wherein the valve parameters are impacted to the greatest level, to any point in between, it will be appreciated that the valve train control device 100 allows a variable control system over an entire range of engine speeds (RPM) using a single camshaft with a specific cam lobe profile. In this exemplary embodiment, a high performance (longer duration than normal) profile may be selected and the valve train control device allows the profile to act normally under higher RPM but then may adjust the valve opening duration as normally required by lower RPM by subtracting the lift duration when the CFB is engaged. As the CFB may be positioned at any point along the A-B range, there is an infinite variation in the control system 100. It is also anticipated that the CFB may be continuously moving throughout the camshaft rotation cycle to provide even greater control, if necessary, and thus greater improvements in engine performance.

Figure 14:
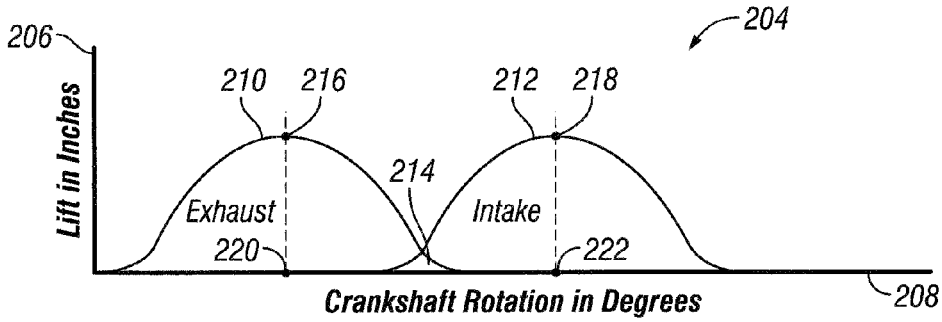
FIG. 14 (Prior Art)
FIG. 14 is a valve lift versus crankshaft rotation profile diagram for a conventional reciprocating piston internal combustion engine valve train associated with a conventional fixed cam timing profile.

Turning now to FIGS. 14-18, a series of valve lift profile diagrams will now be discussed. As shown in FIG. 14, a conventional reciprocating piston internal combustion engine incorporating one or more camshafts with a preselected cam lobe profile offers no variability in performance. More specifically, as shown in FIG. 14, the valve lift profile diagram, generally designated 204 includes a lift axis 206, scaled in linear measurement, and crankshaft rotation axis 208, scaled in degrees, depict an exhaust valve curve 210 and an intake valve curve 212 with a small overlap region 214 wherein both valves are open at the same time, which is desirable to some extent in most instances. However, it will be appreciated that as the engine speed changes, the curve remains the same and thus satisfactory performance is restricted to the single cam lobe profile selected for the engine. For example, if a high lift and duration profile is selected, then the engine will perform satisfactorily when operating at higher engine speeds but poorly when operating at lower RPM or idling. The fixed point of maximum lift 216 for the exhaust valve may be found at crankshaft rotation designated 220 while the fixed point of maximum lift 218 for the intake valve may be found at crankshaft rotation designated 222.

Figure 15:
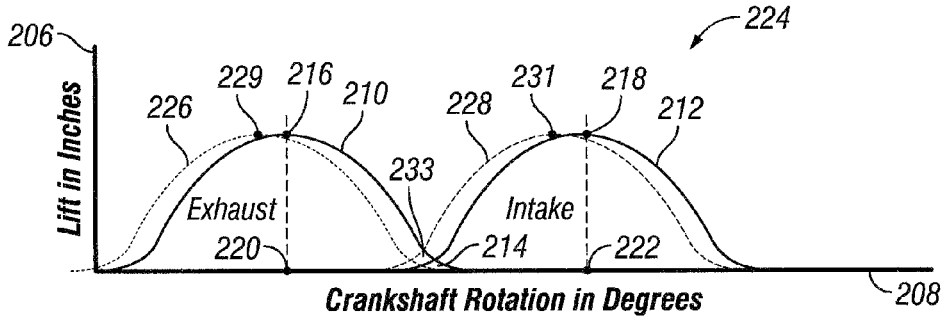
FIG. 15 (Prior Art)
FIG. 15 is a similar view to FIG. 14 for a combustion engine incorporating conventional variable valve timing technology to advance or retard the timing of the valve opening and closing while maintaining the lift and duration characteristics of the cam lobe parameters.

Moving on to FIG. 15, a second lift height versus crankshaft rotation angle diagram, generally designated 224, is illustrated for a conventional variable valve timing technology. In this diagram, the conventional exhaust and intake curves 210 and 212 are the same as for FIG. 14 and are numbered alike. However, in these conventional variable valve timing systems, the exhaust and intake valve lift curves may be shifted in time (advanced or retarded) to an earlier (or later) point in the crankshaft rotation as shown by curves 226 and 228, respectively, to new maximum lift locations 229 and 231, respectively. These systems also shift the overlap region from 214 to 233 as shown in the diagram. Such variable timing systems do not impact the duration but merely the timing of the valve opening and closing events. Thus, such systems are known to provide some additional performance control for an engine employing a camshaft with a preselected cam lobe profile by advancing or retarding the valve timing but still have drawbacks in that valve opening and closing duration times are not variable leaving significant gaps in engine performance.

Figure 16:
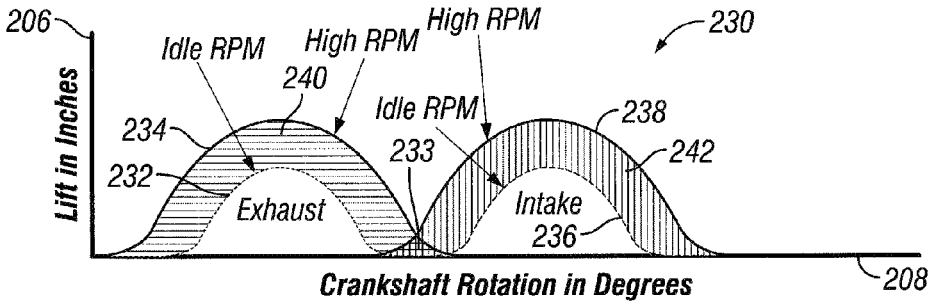
FIG. 16 is a similar view to FIG. 13 but for an ideal system.

Referring now to FIG. 16, for an ideal system that the applicant believes has yet to be achieved in a practical manner. In this ideal system lift profile curve, generally designated 230, the exhaust lift curve may be varied from low lift, short duration profile 232 for idle engine speeds to a maximum lift, long duration profile 234 for higher RPM across the entire crankshaft rotational cycle. Likewise, the intake lift curve 236 for idle engine speeds may be varied out to a maximum lift, long duration profile 238 across the entire crankshaft rotational cycle as well. The areas designated 240 and 242, respectively, indicate the region of variable lift and duration that may be entered into for each exhaust and intake valve, respectively, throughout the crankshaft rotational cycle indicating the improved performance that may be achieved in such an ideal system. It will be appreciated that there is no overlap at lower engine speeds but there is some overlap at higher engine speeds as indicated by region 233.

Figure 17:
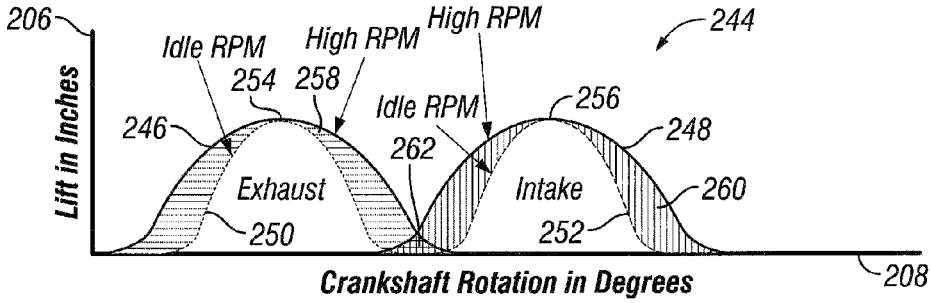
FIG. 17 is a similar view to FIG. 13 but in accordance with the principles of the present invention.
Figure 18:
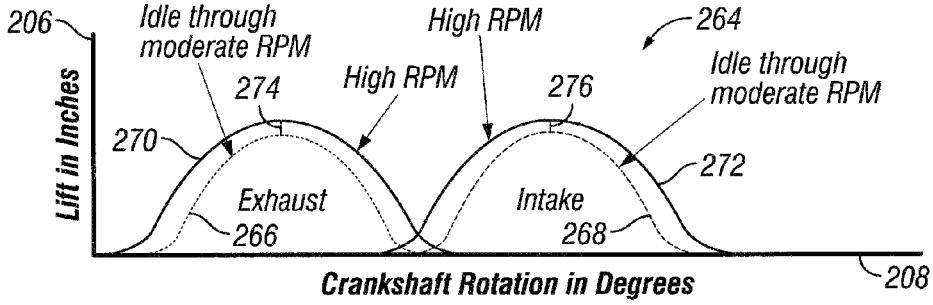
FIG. 18 (Prior Art)
FIG. 18 is a similar view to FIG. 13 but for a conventional Honda VTEC cam switching system.

With respect to the valve train control device 100 disclosed herein, a performance curve similar to that shown in FIG. 17 and generally designated 244 is achievable showing the clear advantages and range of variability over the conventional systems in FIGS. 14-15 and 18 and approaching the ideal system in FIG. 16. As shown in FIG. 17, the exhaust lift curve 246 and intake lift curve 248 for higher engine RPM share a common max lift point 254, 256, respectively, with the lower speed exhaust and intake curves 250 and 252, respectively. This indicates that the variable valve train control device 100 as described herein can use a single cam lobe profile set, with a high lift, long duration profile for example, and reduce the lift duration down to a typical engine idle scenario thus simulating the same conditions and obtaining those efficiencies. In addition, even with a single cam lobe profile set, a range of valve lift parameters as indicated by exhaust variability region 258 and intake variability region 260 are achievable as the CFB 186 is moved over the range of positions from A to B (FIGS. 2-13) instead of being restricted to discrete curves as shown in FIGS. 14-15 and 18 described below. Such a system incorporating the variable valve train control device also allows for a desirable valve opening overlap as indicated by region 262. Although not shown in FIG. 17, the additional capability of the valve train control device 100 to alter the phase timing of the intake and exhaust lift profiles is described above. This essentially adds the capabilities shown in FIG. 15 to those of FIG. 17. The advantages of such a variable valve train control device 100 incorporated into a reciprocating piston internal combustion engine enables a greater range of efficiencies, power, and torque using a single cam lobe profile set.

Turning now to FIG. 18, a lift profile diagram 264 for an engine incorporating a Honda VTEC cam switching system is illustrated. In that system, there are two cam lobes, each with a different profile for each single or dual set of intake and exhaust valves. In that case, at lower RPM, a first low speed profile cam set is selected resulting in the exhaust and intake lift curves 266 and 268, respectively. This is sufficient for idle and moderate speeds. Then, when a certain RPM is reached, the first cam profile is disengaged and the second cam with the higher speed profile is engaged to accommodate the higher engine speeds and requirements thereof as shown by exhaust and intake lift curves 270 and 272, respectively. However, it will be appreciated that each cam set can only accommodate a limited range of RPM most effectively and performance losses occur outside this limited band of RPM. The valve lift parameters are bound to one lift curve or the other and there is a discrete gap in each set of curves, designated 274 and 276, respectively, in which there is a noticeable discrete jump in the valve lift parameters. In effect, the lift parameters of the VTEC system may either follow the low speed lift curves (266, 268) or the high speed lift curves (270, 272) discretely. There is no range of valve lift or duration variability other than one curve or the other. This is opposed to the continuously variable duration parameters available for both low and high engine speeds with the variable valve train control device 100 constructed and operated in accordance with the principles of the present invention.

It will be appreciated that the valve train control devices 100 (FIG. 2) or 300 (FIG. 19) described herein may be used with a single or dual overhead cam system (SOHC or DOHC). It is anticipated that there is ample room along the camshaft next to the primary cam lobes to add the relatively narrower secondary cam lobes. For DOHC configured engines, which often utilize pairs of intake and exhaust valves, a single secondary cam lobe may be used for each dual set of primary intake or exhaust cam lobes.

As for DOHC configured engines, a single secondary camshaft may be used (becoming the third camshaft per cylinder head) instead of adding the secondary lobes to the primary camshafts. Taking advantage of the lobe center phasing between primary intake and exhaust cam lobes, a single secondary lobe per cylinder may be able to control both intake and exhaust valves. This may be achievable regardless of the number of either intake or exhaust valves per cylinder. Intake and exhaust timing may be advanced or retarded by using any of the current methods to advance/retard the single secondary camshaft instead of the primary multiple DOHC cams. It will be appreciated that an individual camshaft may be utilized for all the secondary cam lobes instead of incorporating them on the same camshaft as the primary cam lobes.

The lobe center angle between the primary intake and exhaust cam lobes may be slightly altered, if necessary, by varying the phasing of the two within the variable valve train control device 100 or 300. Apparent timing advancement or retardation of both cams may also occur.

With DOHC engines, the valve train control device 100 will complete the total variation of valve timing desirable/necessary to achieve near-optimum control of engine valves over its operating RPM range. The valve train control device 100 for a DOHC configuration, an independent and moveable CFB reaction surface for each set of intake or exhaust valves and two CFBs, will add variable "lobe center" capability to the engine. This is also known as independent intake and exhaust valve phasing.

The present invention as described herein may also be used with a variety of cam follower styles and the term follower is meant to be inclusive of lifters, tappets, and rocker-type, finger, or cup-type followers whether flat-faced or roller-equipped, and whether a sliding or rolling action across the face of the follower is used. For example, for a direct bucket style embodiment 100 as described herein, this configuration is simpler, but lacks certain advantages of the finger follower style. A "flat" (or slightly convex) dynamic friction ("solid") follower on the primary cam lobe is probably all that can be achieved here. For anything other, total reciprocating mass at the valve, for the valve spring to handle, will be much higher. Controlling valve lash adjustment will not be addressed within this system description, as any methods currently in commercial use should remain applicable.

Considering use with a finger follower style, such configuration could use either roller or "solid" style cam lobe followers that would provide mechanical advantage, for more lift at the valve with a smaller cam lobe along with hydraulic lash adjustment at the pivot point for the "finger". The "solid" style followers could be flat, convex, or concave from a purely functional standpoint.

Figure 19:
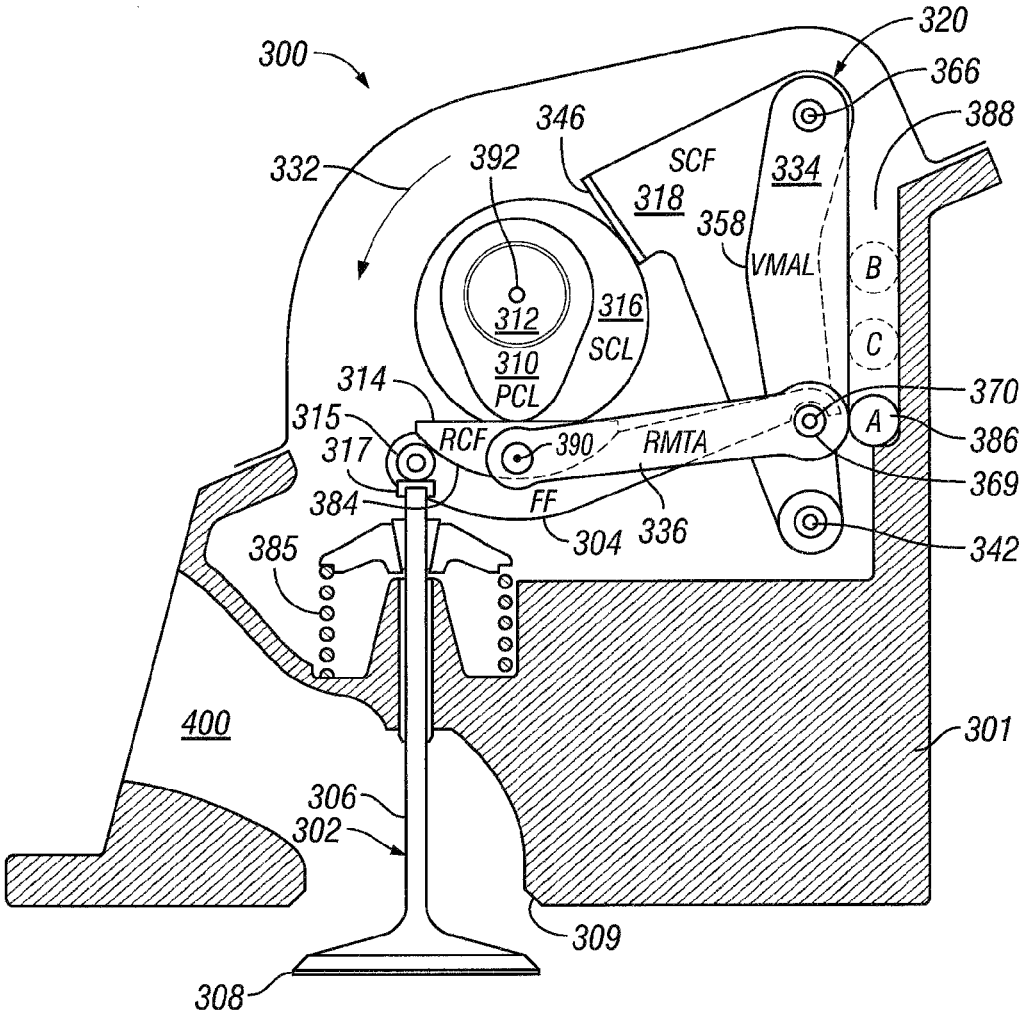
FIG. 19 is a cutaway view of a cylinder head in a conventional reciprocating piston internal combustion engine having a camshaft and a primary cam lobe defining a primary cam lobe profile with the corresponding valve in an open position and further depicting a modified finger style follower and corresponding valve train control device in a disengaged or neutral position in accordance with principles of the present invention.

Turning now to FIG. 19, an alternative embodiment to the bucket style follower valve train control device 100 described above is an exemplary finger style follower valve train control device, generally designated 300, that will now be discussed in more detail. For purposes of this description it will be appreciated that like components have been like numbered as most of the components between the two embodiments are the same or similar except where noted. Also, the spring elements for the SCF and RMTA components have been omitted from the figure for ease of description. However, it will be appreciated that, biasing of the SCF 318 against the SCL 316 and the VMAL 334 against the CFB 386 may be along the lines described above for the first embodiment, including any alternatives described herein.

Turning now to FIG. 19, a portion of a cylinder head 301 is cutaway to reveal a second embodiment of the valve train control device 300 constructed in accordance with the principles of the present invention. Like the prior described embodiment 100, the valve train control device 300 may advantageously be used to variably alter the direct or indirect interaction between an engine valve, generally designated 302, and a primary cam lobe 310 projecting from a corresponding camshaft 312. The interaction between the valve and the primary cam lobe is provided by way of a modified cam finger follower 304 positioned with one end having a small roller 315 or alternative round solid end resting atop an upper end of a valve stem 306 of the valve, with a lash cap 317 spaced in between in this example. As with a conventional valve, the valve stem terminates in a valve head 308 that nests against a valve seat 309 when closed. A valve spring 385 biases the valve head toward a closed position. While it will be appreciated that more than one cam lobe and valve may be used in a system incorporating the valve train control device 300, the construction and interaction of the device 300 for a single valve is explained herein with the understanding that a similar construction may be used for any other primary cam lobe/valve sets.

With specific reference to FIG. 19, the valve train control device 300 generally includes many of the same components as the bucket style follower valve train control device 100 described above. In addition to the basic components of the valve 302, the camshaft 312 with a centerpoint 392, and the primary cam lobe 310, this embodiment further includes the modified finger follower 304 (as opposed to a bucket style follower of the prior embodiment) that includes a similar concave saddle region with an uppermost concave riding surface 384 near a valve side end of the finger follower that rests atop the upper end of the valve stem 306. The concave riding surface of the finger follower is constructed to receive a convex lower surface of a primary cam follower 314 with the two surfaces being constructed to slide or slip relative to one another. The primary cam follower is also pivotally coupled to the RMTA 336 via pin joint 390 like the prior embodiment. The opposing end of the finger follower (shown in dashed lines) rests atop and is pivotally coupled to a pivot stud 369 (that may incorporate a built-in hydraulic valve lash adjustment) projecting out of the cylinder head 301 allowing the opposing roller end of the finger follower to translate up and down about the pivot stud. As with the previous embodiment, a pin joint 370 pivotally couples a VMAL 334 to the RMTA 336. As with the prior embodiment, the primary cam follower 314 includes an upper planar surface constructed to follow the primary cam lobe 310 as the camshaft rotates (direction arrow 332) in operation.

Similar to the prior embodiment, the valve train control device 300 further includes a secondary cam lobe 316 projecting from the camshaft 312 that may be followed by following surface 346 of a secondary cam follower 318. The SCF is pivotally anchored to the cylinder head via pin joint 342 and rocks back and forth in accordance with the profile of the secondary cam lobe.

To alter the orientation of the primary cam follower 314 relative to the primary cam lobe that will result in the alteration of at least one valve operating parameter including duration and/or timing characteristics in response to the rotation of the camshaft, an auxiliary motion transfer device 320 similar to the one described above for the bucket style follower embodiment and including the VMAL 334 and the RMTA 336 in connection with a controller 386, may be provided to couple the primary cam follower 314 to the secondary cam follower 318. This linkage is essentially the same as with the first embodiment with the upper end of the VMAL pivotally coupled to the secondary cam follower via pin joint 366 while the opposing end of the VMAL is pivotally coupled to the RMTA by pin joint 370. The distal end of the RMTA (left hand end as viewed in FIG. 19) is in turn pivotally coupled to the primary cam follower.

As with the prior embodiment, the controller 386 or CFB is positioned in a control gap 388 and against the cylinder head reaction surface and rear edge of the VMAL. The CFB is similarly automatically or selectively operable in response to command by man or machine to move between a disengaged position A and one or more engaged positions B or C (shown in phantom lines) or anywhere between to accomplish the re-orientation of the auxiliary motion transfer device components resulting in a change in orientation between the primary cam follower 314 in relation to the primary cam lobe 310. As with the prior embodiment, with the CFB at position A, the auxiliary motion transfer device 320 is disengaged, during which time the primary cam lobe 310 interacts with the valve 302 as in a conventional valve train. With the CFB at position B or any of the intermediate positions C, the primary cam lobe interacts differently with the primary cam follower thereby impacting the associated reciprocal valve movement.

Despite the change from a bucket style follower to a finger style follower, operation of the finger style follower 300 generally follows the operation of the bucket style follower embodiment 100 discussed above and includes the same "rocking" motion and duration reduction characteristics as determined by the location of the CFB 386. Whether the RCF "rocks", and how much or not depends on the position of the CFB. The CFB at position A shown in FIG. 19 provides essentially no motion at the RCF (yielding an RCF with its cam follower surface essentially remaining at 90 degrees to the valve stem). The CFB at phantom position "B" shown in FIG. 19 would provide the most motion. In response to one or more engine operating parameters, including engine speed or suitable parameters including alternatives discussed herein, the CFB may be positioned anywhere between positions A & B such as position C as shown in FIG. 19. This provides a thoroughly variable amount of degrees of duration that are subtracted from the machined PCL duration.

The basic variable valve train control device 100 or 300 will provide continuously variable valve duration change capability of from zero up to significant angular amounts. The variable valve train control device 100 or 300 for a SOHC configuration (one row of valves and a single CFB) may also provide the capability to advance or retard (change phase) the primary cam lobes. A single variable "backup" surface for the CFB is required.

It will be appreciated that valve train control devices described herein, 100 or 300, respectively, also provide the most significant combined advantages in cam timing variability of any system currently known. Such control devices and engine systems incorporating such devices provide a minimum of simple compact components, at a time when extreme pressure is being applied to the industries using internal combustion engines to conserve fuel and decrease pollutants, at the same time providing an acceptable level of performance.

It will further be appreciated that valve-spring forces for the embodiments described herein coupled with the low-friction surfaces at the angles involved between the exemplary PCL and RCF will create the tendency of the RCF to ride down the back slope of the PCL after maximum lift, pulling itself and attached components away from the CFB. Spring generated force may be needed to counteract this unless the CFB and VMAL, in turn, are fully captured by the CFB reaction surface, not allowing this errant un-controlled motion. The VMAL would be captured if the CFB were to ride in a slot in the VMAL that has a width to match the CFB diameter. One side of the VMAL slot reacts against the force against the CFB generated as the RCF rides up the valve opening side of the PCL. The other side of the VMAL slot reacts against the reversed vector force generated as the RCF rides down the valve closing side of the PCL. This last reversed vector force generated against the CFB, wanting to pull it away from the CFB reaction surface 162, must in turn be countered by some additional structure related to the CFB reaction surface.

While the present invention has been described herein in terms of a number of preferred embodiments, it will be appreciated that various changes, uses, and improvements may also be made to the invention without departing from the scope and spirit thereof. For example, while the above-described valve train control devices are in terms of shortening the duration of a valve opening, an alternative configuration can also add duration to the valve opening allowing for the use of a low end RPM primary cam lobe profile.

What is claimed is:

1. A valve train control device for use in a reciprocating piston internal combustion engine having a camshaft with a primary cam lobe defining a primary cam lobe profile constructed to directly or indirectly translate camshaft rotational motion into linear motion of a corresponding valve in accordance with the profile, the device comprising:

a primary cam follower positioned in an operational path between the primary cam lobe and the corresponding valve, the primary cam follower constructed to follow the primary cam lobe;

a secondary cam lobe projecting from the camshaft;

a secondary cam follower constructed to follow the secondary cam lobe; and an auxiliary motion transfer device with a linkage, including a lever component, pivotally coupling the secondary cam follower to a first region of a reciprocating motion transfer arm and the reciprocating motion transfer arm having a second region pivotally coupled to the primary cam follower, the motion transfer device being responsive to at least one engine parameter to shift the primary cam follower during at least a portion of the camshaft rotation to alter at least one valve operating parameter relative to a set of valve parameters defined by the primary cam lobe profile interacting with an unshifted primary cam follower.

2. The device as set forth in claim 1 wherein:
the secondary cam follower continuously follows the secondary cam lobe during camshaft rotation.

3. The device as set forth in claim 1 further including:
a biasing element operable to maintain contact between the secondary cam follower and the secondary cam lobe during camshaft rotation.

4. The device as set forth in claim 1 wherein:
the auxiliary motion transfer device slides the primary cam follower along the primary cam lobe and back and forth across a centerline passing through the camshaft during at least a portion of camshaft rotation in response to at least one engine parameter.

5. The device as set forth in claim 1 wherein:
the auxiliary motion transfer device imparts a partial rotation of the primary cam follower relative to the primary cam lobe to reduce the duration of the valve opening.

6. The device as set forth in claim 1 wherein:
the secondary cam lobe is mounted on the same camshaft and adjacent the primary cam lobe.

7. The device as set forth in claim 1 wherein:
the auxiliary motion transfer device is operable to shift a centerpoint of the primary cam follower relative to a centerpoint of the camshaft in response to at least one engine parameter during camshaft rotation.

8. The device as set forth in claim 1 wherein:
the primary cam follower may be rotated by the auxiliary motion transfer device through an angle of rotation relative to a line passing through the centerpoint of the camshaft and the centerpoint of the primary cam follower in an unshifted position during camshaft rotation.

9. The device as set forth in claim 1 wherein:
the primary cam follower has an unshifted orientation relative to the outer surface of the primary cam lobe and may assume one or more shifted orientations along the outer surface of the primary cam lobe during at least a portion of the camshaft rotation.

10. The device as set forth in claim 1 wherein:
the primary cam follower is operable to be shifted along the primary cam lobe by motion of the transfer arm relative a centerline passing through the camshaft.

11. The device as set forth in claim 1 wherein:
the auxiliary motion transfer device includes a controller acting as a fulcrum in contact with a reaction surface in a cylinder head of the reciprocating piston internal combustion engine and a surface of the lever.

12. The device as set forth in claim 11 wherein:
the controller is selectively adjustable through a range of positions including a disengaged position, a fully engaged position, and one or more intermediate positions.

13. The device as set forth in claim 11 wherein:
the controller includes a neutral position wherein the auxiliary motion transfer device maintains the primary cam follower in an unshifted position.

14. The device as set forth in claim 11 wherein:
the controller is responsive to at least one engine operating parameter to change the position of the primary cam follower.

15. The device as set forth in claim 11 wherein:
the controller may be continuously and variably adjusted throughout a range of motion.

16. The device as set forth in claim 11 further including:
a biasing element operable to maintain contact between the lever and the controller.

17. A valve train control device for use in a reciprocating piston internal combustion engine having a camshaft with a primary cam lobe defining a primary cam lobe profile constructed to directly or indirectly translate camshaft rotational motion into linear motion of a corresponding valve in accordance with the profile, the device comprising:
a primary cam follower having a semi-cylindrical convex riding surface opposing a primary cam following surface positioned in an operational path between the primary cam lobe and the corresponding valve with the primary cam follower constructed to follow the primary cam lobe;
a secondary cam lobe projecting from the camshaft;
a secondary cam follower constructed to follow the secondary cam lobe;
an auxiliary motion transfer device coupling the primary cam follower to the secondary cam follower, the motion transfer device being responsive to at least one engine parameter to shift the primary cam follower during at least a portion of the camshaft rotation to alter at least one valve operating parameter relative to a set of valve parameters defined by the primary cam lobe profile interacting with an unshifted primary cam follower; and
the valve includes a valve head and an opposing end with a saddle region complementary to the riding surface of the primary cam follower whereby the primary cam follower may be slidably adjusted on the saddle region relative to the riding surface.

18. A valve train control device for use in a reciprocating piston internal combustion engine having a camshaft with a primary cam lobe defining a primary cam lobe profile constructed to directly or indirectly translate camshaft rotational motion into linear motion of a corresponding valve in accordance with the profile, the device comprising:
a variable position primary cam follower positioned in an operational path between the primary cam lobe and the corresponding valve and constructed to follow the primary cam lobe;
a secondary cam lobe projecting from the camshaft;
a secondary cam follower constructed to follow the secondary cam lobe;
a variable mechanical advantage lever pivotally coupled to the secondary cam follower;
a reciprocating motion transfer arm pivotally coupled to the variable mechanical advantage lever and also pivotally coupled to the primary cam follower; and
a variable position fulcrum mounted between a reaction surface of a cylinder head in the reciprocating piston internal combustion engine and a leverage surface of the variable mechanical advantage lever, the fulcrum being responsive to engine speed to change position along the reaction surface to shift the variable mechanical advantage lever and in turn slide the variable position primary cam follower along the primary cam lobe to vary the duration characteristics of the corresponding valve.

* * * * *